US010808402B2

(12) United States Patent
Adams

(10) Patent No.: US 10,808,402 B2
(45) Date of Patent: Oct. 20, 2020

(54) CEILING MODULE

(71) Applicant: Instyle Contract Textiles Pty. Ltd., Mascot, NSW (AU)

(72) Inventor: Philip Adams, Mascot (AU)

(73) Assignee: Instyle Contract Textiles Pty. Ltd., Mascot (AU)

( * ) Notice: Subject to any disclaimer, the term of this patent is extended or adjusted under 35 U.S.C. 154(b) by 0 days.

(21) Appl. No.: 16/176,879

(22) Filed: Oct. 31, 2018

(65) Prior Publication Data

US 2020/0123772 A1 Apr. 23, 2020

(30) Foreign Application Priority Data

Oct. 22, 2018 (AU) ..... 2018903991

(51) Int. Cl.

| | |
|---|---|
| ***E04C 2/42*** | (2006.01) |
| ***E04B 9/34*** | (2006.01) |
| ***E04B 9/18*** | (2006.01) |
| *E04B 9/24* | (2006.01) |
| *E04B 9/12* | (2006.01) |

(52) U.S. Cl.

CPC ..... *E04B 9/345* (2013.01); *E04B 9/18* (2013.01); *E04B 9/12* (2013.01); *E04B 9/241* (2013.01)

(58) Field of Classification Search

CPC . E04B 9/366; E04B 9/10; E04B 9/363; E04B 9/28; E04B 9/36; E04B 2001/829; E04B 9/04; E04B 1/8209; E04B 9/001; E04B 9/067

USPC ..... 52/666, 665, 668, 222, 506.06, 506.08, 52/144, 238.1, 747.1, 220.6

See application file for complete search history.

(56) References Cited

U.S. PATENT DOCUMENTS

| | | | | |
|---|---|---|---|---|
| 2,437,186 A * | 3/1948 | Collins | E04C 2/423 | 52/667 |
| 2,689,026 A * | 9/1954 | Zingone | E04B 9/345 | 52/507 |
| 4,532,749 A * | 8/1985 | Perk | E04C 2/423 | 52/668 |
| 4,665,674 A * | 5/1987 | Brugman | E04B 9/122 | 52/506.06 |
| 4,928,471 A * | 5/1990 | Bartley | E04C 2/423 | 52/664 |
| 5,784,741 A * | 7/1998 | Mangone | E01D 19/125 | 14/73 |
| 7,803,466 B2 * | 9/2010 | Dorsy | E04C 2/08 | 428/131 |
| 9,038,326 B2 * | 5/2015 | Bergman | E04B 9/366 | 52/144 |

(Continued)

*Primary Examiner* — Chi Q Nguyen

(74) *Attorney, Agent, or Firm* — Seed Intellectual Property Law Group LLP

(57) ABSTRACT

A ceiling module and method of constructing the same, the ceiling module mountable on a suspended ceiling grid structure and including a plurality of elongate blade members having opposing faces, at least a part of each face of at least two blade members being substantially mutually opposed, at least one elongate cross member extending at least between at least two blade members such that the plurality of blade members are connected to form an arrangement; and at least one support member, releasably engageable with the suspended grid ceiling structure and associated with at least one of the blade members to support the plurality of blade members from the suspended ceiling grid structure.

20 Claims, 23 Drawing Sheets

(56) References Cited

U.S. PATENT DOCUMENTS

| | | | | |
|---|---|---|---|---|
| 9,353,521 | B2 * | 5/2016 | Waters | E04B 9/00 |
| 10,273,676 | B2 * | 4/2019 | Wyllie | E04B 2/7416 |
| 2006/0218872 | A1 * | 10/2006 | Bigott | E04C 2/423<br>52/660 |
| 2013/0192772 | A1 * | 8/2013 | Damen | E06B 9/04<br>160/196.1 |
| 2014/0157689 | A1 * | 6/2014 | Bergman | E04B 9/366<br>52/144 |
| 2017/0089064 | A1 * | 3/2017 | Frantz | B32B 3/02 |
| 2019/0106883 | A1 * | 4/2019 | Moore | E04B 9/366 |

* cited by examiner

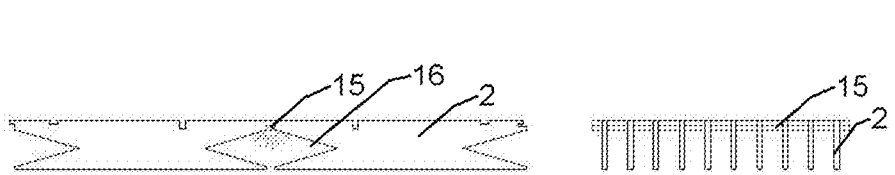
FIG. 17C
FIG. 17B
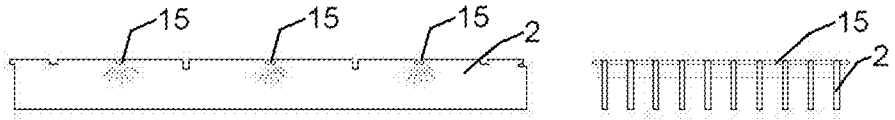
FIG. 18C
FIG. 18B
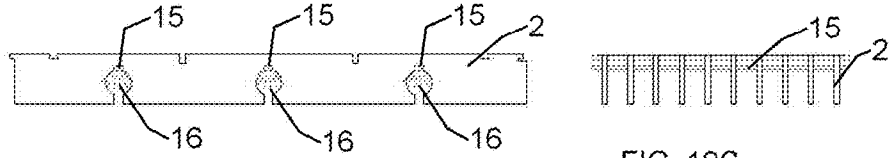
FIG. 19C
FIG. 19B
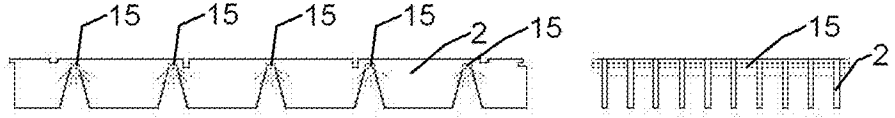
FIG. 20C
FIG. 20B
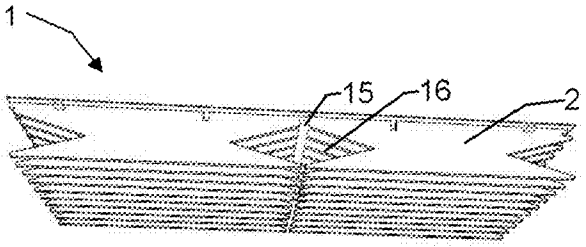
FIG. 17A
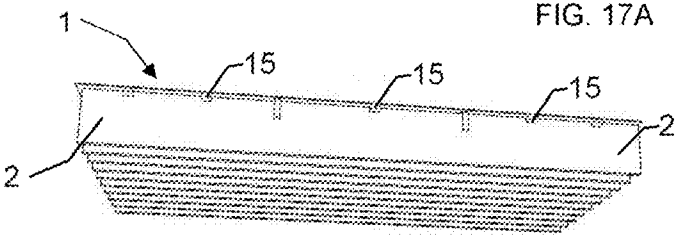
FIG. 18A
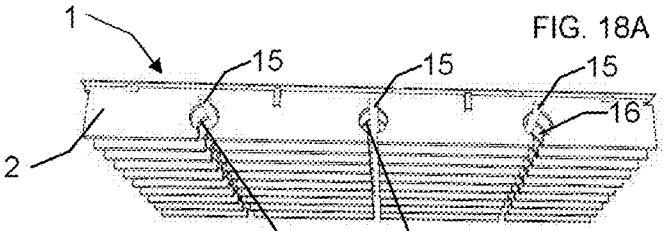
FIG. 19A
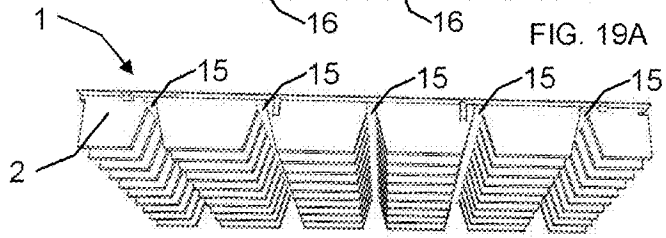
FIG. 20A

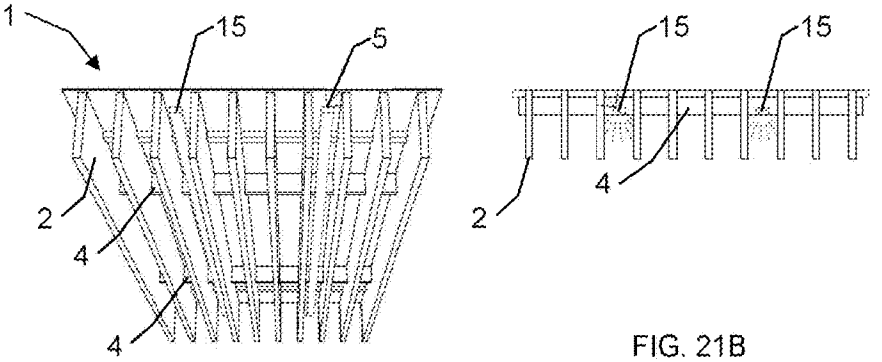
FIG. 21A
FIG. 21B
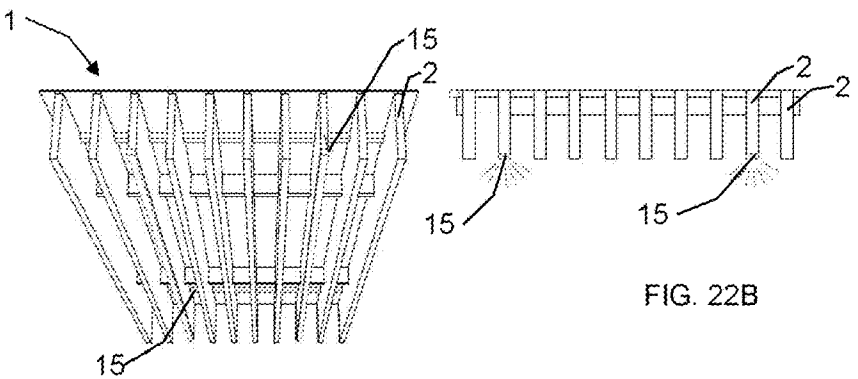
FIG. 22A
FIG. 22B
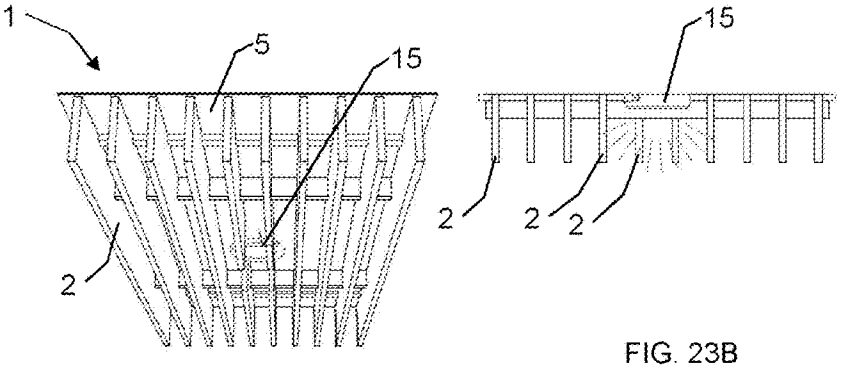
FIG. 23A
FIG. 23B
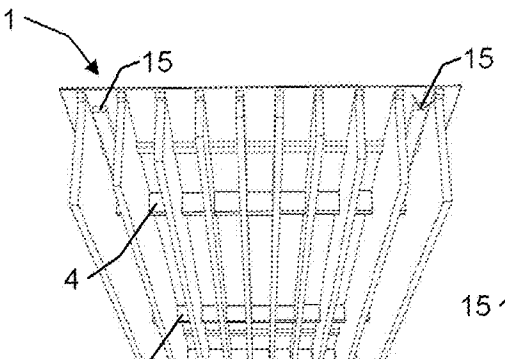
FIG. 24A
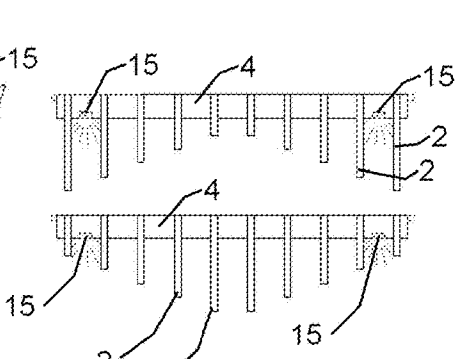
FIG. 24B

CEILING MODULE

BACKGROUND

Technical Field

The present disclosure relates to ceiling components and, in particular, to a ceiling module for use in suspended ceiling structures.

Description of the Related Art

Any discussion of the prior art throughout the specification should in no way be considered as an admission that such prior art is widely known or forms part of common general knowledge in the field.

In building construction, it is common practice to install ceiling structures known as "suspended ceilings" or "false ceilings." Such ceiling structures commonly utilize a suspended grid system on which a plurality of flat ceiling tiles are supported.

Commonly used suspended ceiling systems have shortcomings in visual attractiveness, customizability and acoustic performance. Therefore, improvements are desirable.

It is an object of the present disclosure to overcome or ameliorate at least one of the disadvantages of the prior art, or to provide a useful alternative.

BRIEF SUMMARY

According to one aspect of the present disclosure there is provided a ceiling module mountable on a suspended ceiling grid structure, the ceiling module including a plurality of elongate blade members, at least a part of faces of at least two blade members being mutually opposed; at least one elongate cross member extending at least between adjacent blade members such that the plurality of blade members are connected to form an arrangement; and at least one support member, releasably engageable with the suspended grid ceiling structure and associated with at least one of the blade members to support the plurality of blade members from the suspended ceiling grid structure.

Preferably, the ceiling module includes at least a pair of support members located at, or adjacent, opposing edges of the arrangement. An edge of the arrangement may be any side region or end region of the arrangement. Preferably, respective ends of the blade members define opposing end edges of the module. Preferably, at least two outermost blade members define opposing side edges of the module.

Preferably, the support members are located at opposing ends of at least one cross member. The pair of support members is defined by a pair of projections on respective ends of the cross member. The tabs may be attached to the cross member or alternatively integral with the cross member. Preferably, the support member is integral with at least one cross member.

Preferably the support member extends through the blade members to support the blade members by an interference fit. In some implementations, the support member extends through a top edge of each blade members, for example, through a notch or indent in the blade members. In other implementations the support member may extend through a region of each blade member adjacent the edge. Alternatively, the support member may extend through a substantially central region of each blade member. In other implementations, the support member may extend through substantially the same location relative to the edge of each blade member. In other implementations, the blade members may be offset relative to the support member such that the support member extends through a different location on different blade members.

Preferably, the blade members are slidable along the length of the support member. Alternatively, the blade members may be fixed relative to the support member.

In preferred implementations, the support member is a rail extending through the plurality of blade members and engageable with the grid structure at each of its ends. The rail may have a cross-sectional shape selected from the group including, but not limited to, dovetail, square, rectangle triangle, circle, hexagon or other suitable shapes.

The rails may be made from any material of suitable rigidity and strength for supporting the module, including wood, plastics, metal, fiberglass or composited. Preferably the rails are made from aluminum.

In alternative implementations, the support members are located at respective ends of the blade members, for example but not limited to, as tab members, hooks or other suitable connecting means on respective ends of the blade members. In still other implementations, the support members are located on the side edges of the module and associated with the outermost blade members, for example as tab members, hooks or other suitable connecting means protruding outwardly or upwardly from the respective outermost blades.

Preferably, the ceiling module includes at least one spacing member adapted for locating the blade members in a spaced apart configuration. Preferably, the blade members are evenly spaced apart. Preferably, the spacing member is integral with at least one cross member. Preferably, the spacing member includes blade engaging features adapted for frictionally engaging the blade members. Preferably, the blade engaging features are a plurality of notches or slots in the spacing member. Preferably the slots are evenly spaced along the length of the spacing member such that the blade members are evenly spaced apart when engaged by the slots. Preferably, the blade members have corresponding slots or slots along their top edges, adapted to engage an un-slotted portion of the spacing member such that the blade members and the spacing members inter-engage to form a series of halved joints.

Preferably, the ceiling module includes at least two cross-members in a spaced apart configuration. Preferably, at least one cross member is a support member and at least one other cross member is a spacing member. In some implementations, the module includes a pair of support members and at least two spacing members.

Preferably, the blade members extend substantially parallel to a plane defined by the suspended ceiling grid structure. Preferably, the elongate blade members extend substantially parallel to each other. Preferably, exposed longitudinal edges of the plurality of blade members provide a decorative visual appearance to the ceiling module when viewed in combination.

In some implementations, the exposed longitudinal edges, when viewed in combination, give the impression of a three-dimensional relief. Relief in this context is to be understood as meaning a design which stands out to a greater (high relief) or lower (low relief) extent from the surrounding material, created by a difference in height or depth from the surrounding material. Preferably, this is achieved by removing or alternatively adding to a predetermined portion of at least one blade member to create a variation in the width of the blade and, thus, a variation in the height of the exposed longitudinal edge.

It will be appreciated that such implementations can create the impression of three-dimensional pattern or form in the suspended ceiling when multiple such modules are utilized in combination. In some implementations, the exposed longitudinal edges, when viewed in combination, give the impression of an undulating surface.

In some implementations, at least a portion of at least one cross member contributes to the decorative visual appearance. In some implementations, exposed longitudinal edges of a plurality of cross members contribute to the decorative visual appearance to give the impression of a lattice when viewed in combination with the exposed longitudinal edges of the plurality of blades.

In some implementations, end regions of the blades are configured to engage the suspended ceiling grid structure to provide additional support to the blades members. Preferably, the end regions of the blade members are configured to abuttingly engage end regions of blade members of adjacent modules when installed. It will be appreciated that this creates the visual appearance that the adjacent abutting blades are continuous or integral with each other. Preferably, the ceiling module is configured such that when a plurality of the ceiling modules are installed on a suspended ceiling grid structure, the ceiling modules at least partially conceal the suspended ceiling grid structure from view. Preferably, the ceiling modules substantially conceal the suspended grid ceiling structure from view.

Preferably, the ceiling module is configured to alter the acoustic properties of an area below a suspended ceiling grid system. Preferably, the ceiling module reduces the reverberant time of an internal room or open plan space within a building.

Preferably, at least one of the blade members is made from a material having sound absorbing or sound dampening properties. Preferably, the sound absorbent material is porous. Preferably all of the blade members and, optionally, some or all of the cross members, are made from a material having sound dampening properties. It will be appreciated that the module advantageously presents a large surface area of sound absorbent material relative to the dimensions of the module. It will be appreciated that absorbing sound waves and thus reducing acoustic reverberation is particularly advantageous in voluminous spaces, for example open plan offices.

The blade members and/or support members are preferably made from a recycled material, preferably PET. Preferably, the blade members are all made from the same material. Alternatively, the blade members may be made from different materials. Preferably, at least one of the cross members is made from the same material as the blade members.

The ceiling module preferably includes a cover attachable to the arrangement extending across at least a portion of the arrangement. Preferably the cover is attachable to any one of the blade members, cross members and/or support members.

Preferably, the cover is attached to the arrangement, directly or indirectly, by a suitable fastener. Preferably the fastener is a plurality of pins. It will be appreciated that the fastener is not limited to pins and may include adhesive, hook and loop, sewing, tacks, pins, screws, nails or other suitable fasting means. Preferably, the cover is removably attached to the arrangement.

In some implementations, the cover obscures a void above the suspended ceiling grid system from visibility. In other implementations, where visibility of the void is desirable, the cover may be omitted or extend across a smaller portion of the arrangement.

In some implementations, the cover is in the form of a sheet. Preferably, the cover is a scrim. In other implementations, the cover may be formed from an alternative material including, but not limited to, various textiles, wood or wood products, plastics or metals.

In some implementations, the cover may contribute to acoustic dampening or sound wave absorption properties of the module.

The ceiling module is preferably adapted to be installed in proximity to a fixture selected from the group including lights, emergency lights, vents, speakers, smoke detectors or sprinklers. Preferably, the fitting is installed in the same grid section as the module. It will be appreciated that, when the fitting is a light fitting, the light may contribute to or enhance the decorative visual appearance of the module.

Preferably the module can be quickly and easily removed from the suspended ceiling grid system for ease of accessing building services in a void above the suspended ceiling grid.

In some implementations, a light fitting is supportable above the module when the module is installed in the suspended grid ceiling system. In other implementations, the module is adapted to engage the light fitting.

In some implementations, the blade members are collectively shaped to define a cavity in the ceiling module for at least partially receiving a fixture selected from the group including lights, emergency lights, vents, speakers, smoke detectors or sprinklers therein. In some implementations, the cavity is substantially parallel to a plane defined by the suspended ceiling grid system. In other implementations, the cavity is substantially orthogonal to a plane defined by the suspended ceiling grid system.

In alternative implementations, a light may be integral with at least one of the blade members and/or at least one of the cross members. In some implementations, the light is an LED strip attachable to at least one blade member. In other implementations, the light is an LED strip attachable to at least one cross member.

In some implementations, the light, when installed with the module, is at least partially concealed from view by the module. Alternatively, the light when installed with the module may be exposed.

In implementations adapted for installation in proximity to fire protection systems, the module is preferably adapted to receive a fire sprinkler between at least two adjacent blade members. Alternatively, the blade members of the module may be arranged to allow fluid from a fire sprinkler positioned above the module to fall between at least two of the blade members to a region below the module. In some implementations, the module may include a sprinkler engaging member.

According to a second aspect of the present disclosure, there is provided a kit for a ceiling module according to the first aspect of the present disclosure, the kit including a plurality of blade members; at least one elongate cross member adapted to extend at least between the blade members to connect the blade members; at least one support member adapted for releasable engagement with the suspended ceiling grid structure and adapted to be associated with at least one of the blade members to support the plurality of blade members from the suspended grid ceiling structure.

Preferably, the blade members and/or at least one cross member are provided in at least one substantially flat sheet. Preferably, the sheet includes a protective portion at least partially surrounding the blade members and/or cross members. Preferably, the blade members and/or cross members are releasably attached to the protective portion, for example, by a frangible portion such as a perforated region or frangible tabs.

Preferably, outlines of shapes corresponding to a predetermined profile of each of the blade members and/or cross members are at least partially cut into the at least one sheet, for example, by CNC router, laser, mill, jigsaw or other suitable cutting methods.

According to a third aspect of the present disclosure there is provided a method of constructing a ceiling module according to the first aspect of the present disclosure or using a kit according to the second aspect of the present disclosure, the method including the steps of providing a plurality of elongate blade members; providing at least one elongate cross member adapted to extend between at least two blade members such that the plurality of blade members are connected to form an arrangement; adapted to be releasably engageable with the suspended grid ceiling structure and associated with at least one of the blade members to support the plurality of blade members from the suspended ceiling grid structure; and connecting the blade members to the cross member such that at least a part of faces of at least two blade members are mutually opposed.

BRIEF DESCRIPTION OF THE SEVERAL VIEWS OF THE DRAWINGS

Preferred implementation of the present disclosure will now be described, by way of example only, with reference to the accompanying drawings in which:

FIGS. 17A to 17C are perspective, side and end views, respectively, of a ceiling module according to another implementation of the present disclosure where the ceiling module is adapted to engage a lighting fixture;

FIGS. 18A to 18C are perspective, side and end views, respectively, of a ceiling module according to another implementation of the present disclosure where the ceiling module is adapted to engage a lighting fixture;

FIGS. 19A to 19C are perspective, side and end views, respectively, of a ceiling module according to another implementation of the present disclosure where the ceiling module is adapted to engage a lighting fixture;

FIGS. 20A to 20C are perspective, side and end views, respectively, of a ceiling module according to another implementation of the present disclosure where the ceiling module is adapted to engage a lighting fixture;

FIGS. 21A and 21B are perspective and end views, respectively, of a ceiling module according to another implementation of the present disclosure where the ceiling module is adapted to engage a lighting fixture;

FIGS. 22A and 22B are perspective and end views, respectively, of a ceiling module according to another implementation of the present disclosure where the ceiling module is adapted to engage a lighting fixture;

FIGS. 23A and 23B are perspective and end views, respectively, of a ceiling module according to another implementation of the present disclosure where the ceiling module is adapted to engage a lighting fixture; and FIGS. 24A and 24B are a perspective view and two end views, respectively, of a ceiling module according to another implementation of the present disclosure where the ceiling module is adapted to engage a lighting fixture.

DETAILED DESCRIPTION

Figure 1A:
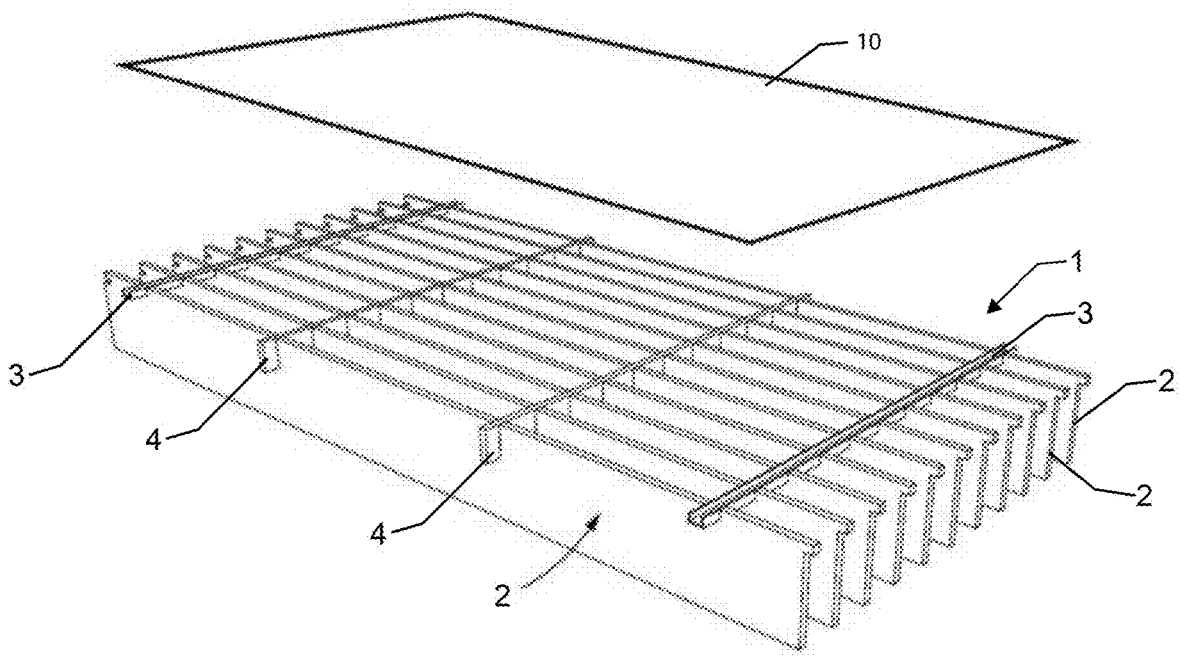
FIG. 1A is a partially exploded perspective view of a ceiling module according to the present disclosure.
Figure 1B:
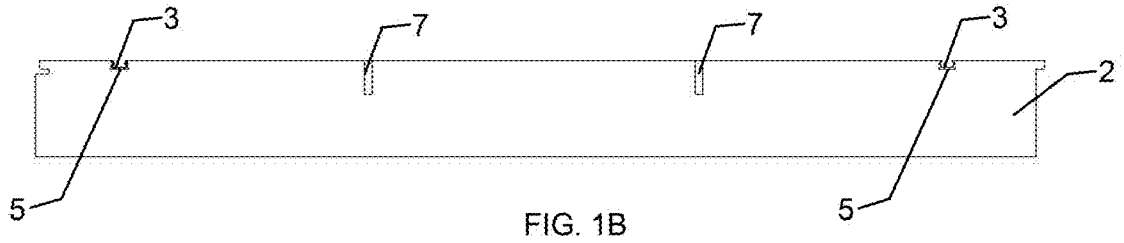
FIG. 1B is a side view of the ceiling module of FIG. 1A.
Figure 1C:
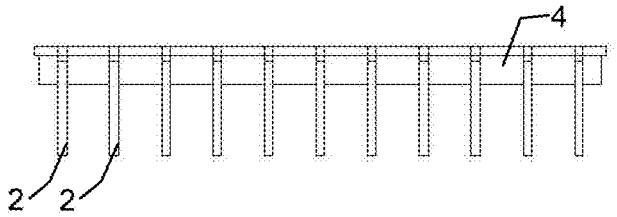
FIG. 1C is an end view of the ceiling module of FIG. 1A.

Referring initially to FIGS. 1A-1C, a ceiling module 1 includes a plurality of elongate blade members 2, support members in the form of support rails 3, a plurality of cross-members in the form of spacing members 4, and a cover 10.

The blade members 2 are arranged such that the faces of adjacent blade members are mutually opposed and substantially parallel. The blade members 2 are made from porous polymer PET panels. It will be appreciated this material choice is advantageous as the blade members can be manufactured from recycled materials, have sound absorbent qualities, and are relatively light weight.

By suspending the plurality of sound absorbent blade members 2, the ceiling module 1 advantageously provides a large surface area of sound absorbent material relative to the area of the suspended ceiling grid structure occupied by each module. When installed, this has the effect of reducing the reverberant time of an internal or open plan space.

The support rails 3 extend through the blade members 2 and are adapted to be releasably engageable with the suspended ceiling grid structure at each of their ends. As shown in FIG. 1A the rails 3 extend through the blade members 2 in openings in the form of notches 6 at the top edge of the blade members to support the blade members from the suspended ceiling grid structure by an interference fit. The preferred cross-sectional profile for the rails 3 is a dovetail cross section, as illustrated in FIG. 1B. Each blade member 2 has a correspondingly shaped notch 5 for receiving the rail 3 by a sliding fit.

Figure 2A:
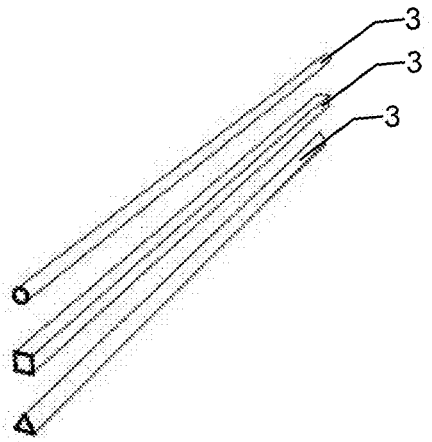
FIG. 2A is a perspective view of three alternative implementations of a support rail for a ceiling module.

FIG. 2A illustrates alternative cross-section shapes for the support rail 3 including triangular, circular and square. It will be appreciated that the present disclosure is not limited to these examples and that other suitable cross-sectional shapes may be employed.

Figure 2B:
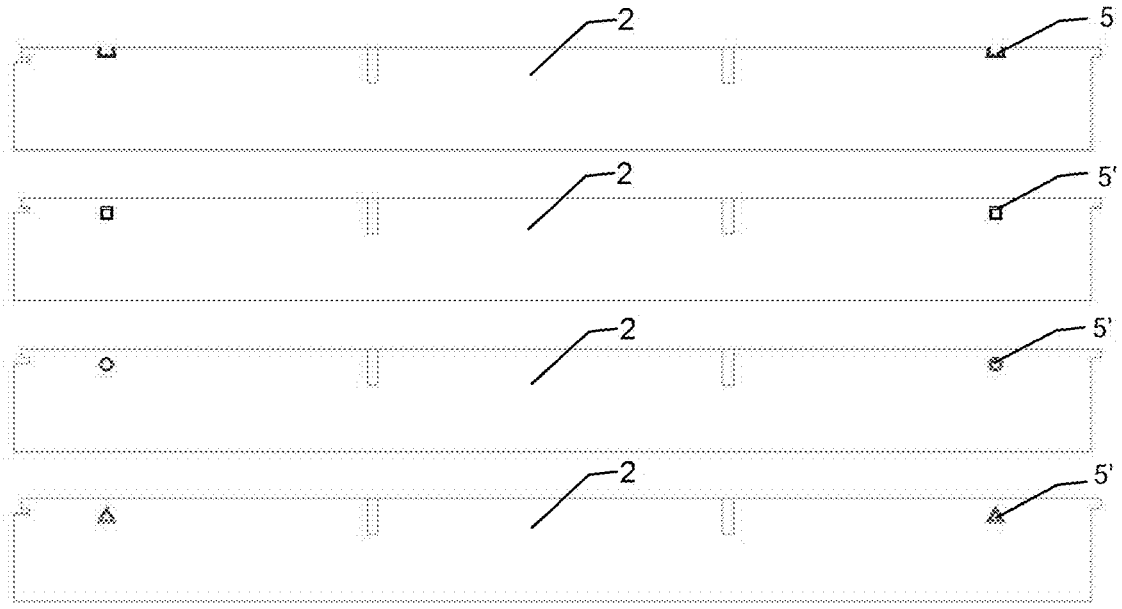
FIG. 2B is a side view of four implementations of blade members corresponding to various implementations of support rails illustrated in FIGS. 1B and 2A.

FIG. 2B illustrates a number of options for the blade member notch 5. As can be seen, the rail may extend through an opening in the form of a notch 5 in top edge of the blade members or, alternatively, through correspondingly shaped openings in the form of holes 5' in a portion of the blade members adjacent the top edge of the blade members 2.

Figure 3:
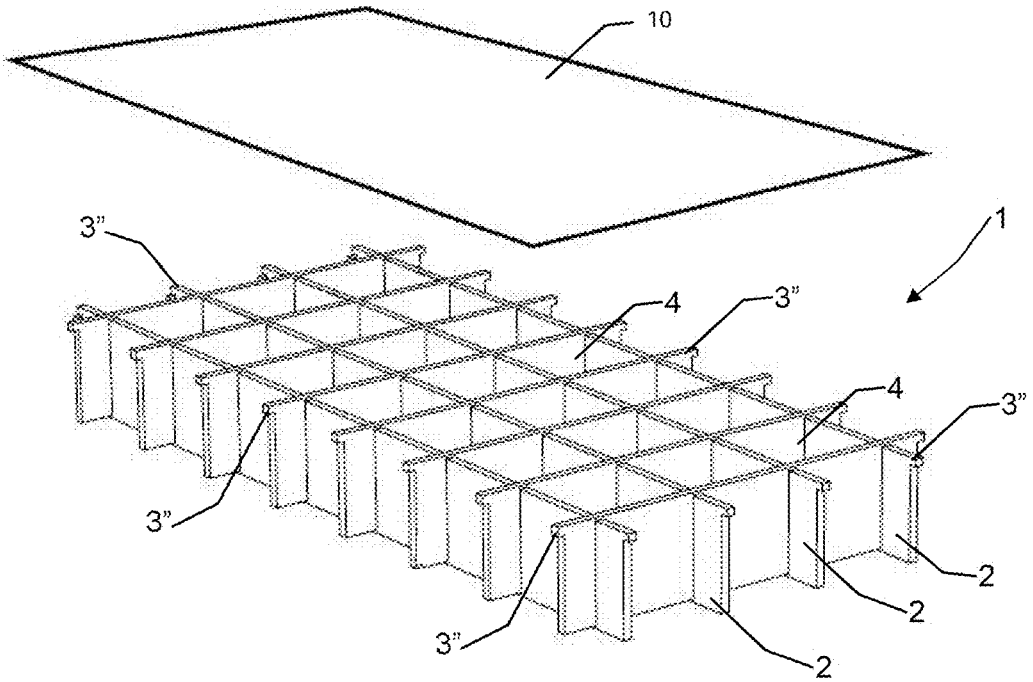
FIG. 3 is a perspective view of another implementations of a ceiling module according to the present disclosure.

FIG. 3 illustrates an alternative implementation without a support rail, in which support members 3" are provided in the form of tabs on respective ends of the blade members 2 and spacing members 4. It will be appreciated that, in other implementations, the tabs need not be on all of the blade members 2 and cross members 4 and may instead be present only on select blade members and cross members. Alternatively, tabs may be provided only on select blade members 2, or only on select cross members 4.

The spacing members 4 extend between the blade members 2 and connect the plurality of blade members 2 to form an arrangement. As is most clearly illustrated in FIGS. 4B, 5C and 6B, the spacing members 4 are in the form of combs having blade-engaging slots 6 evenly spaced along their length. The blade members 2 have corresponding slots 7 along a top longitudinal edge. The slots 7 on the blade members 2 and the blade engaging slots 6 on the spacing members 4 inter-engage to form a series of halved joints, such that the blade members 2 are evenly spaced apart along the length of the spacing members 4.

FIGS. 4A to 4E illustrate a series of assembly steps for assembling a ceiling module 1 according to another implementation of the present disclosure from a kit of parts. The kit is provided to the user in a "flat-pack" arrangement and assembled by the user. It will be appreciated that the substantially flat and elongate shape of the blade members 2 and cross members 4 allows them to be produced in a single sheet 8 or a plurality of sheets. This advantageously reduces the costs associated with manufacture and freight, thus allowing the modules to be produced and supplied at a lower price.

Figure 4A:
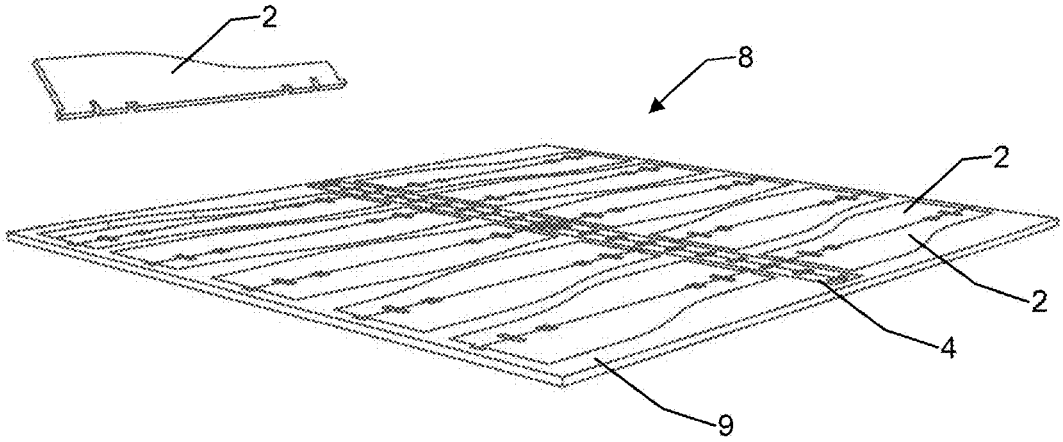
FIGS. 4A to 4E are perspective views illustrating a series of assembly steps for assembling a ceiling module according to another implementation of the present disclosure.

FIG. 4A illustrates a flat sheet 8 of PET material, into which the outlines or profiles of shapes defining the blade members 2 and cross members 4 have been cut. The sheet 8 includes a protective surround portion 9 of redundant material which does not form part of the completed module 1 but serves to locate and protect the module components during transport. The blade members 2 and cross members 4 are releasably attached to the protective surround 9 such that they may be removed from the sheet by the end user. FIG. 4A shows one blade member 2 component having been removed from the protective surround portion 9.

Figure 4B:
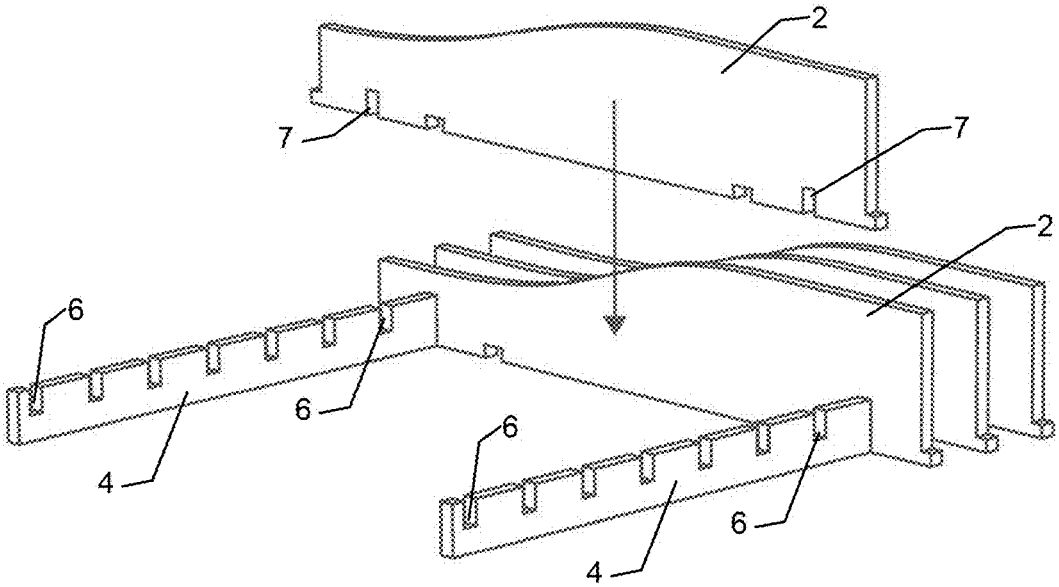
Figure 4C:
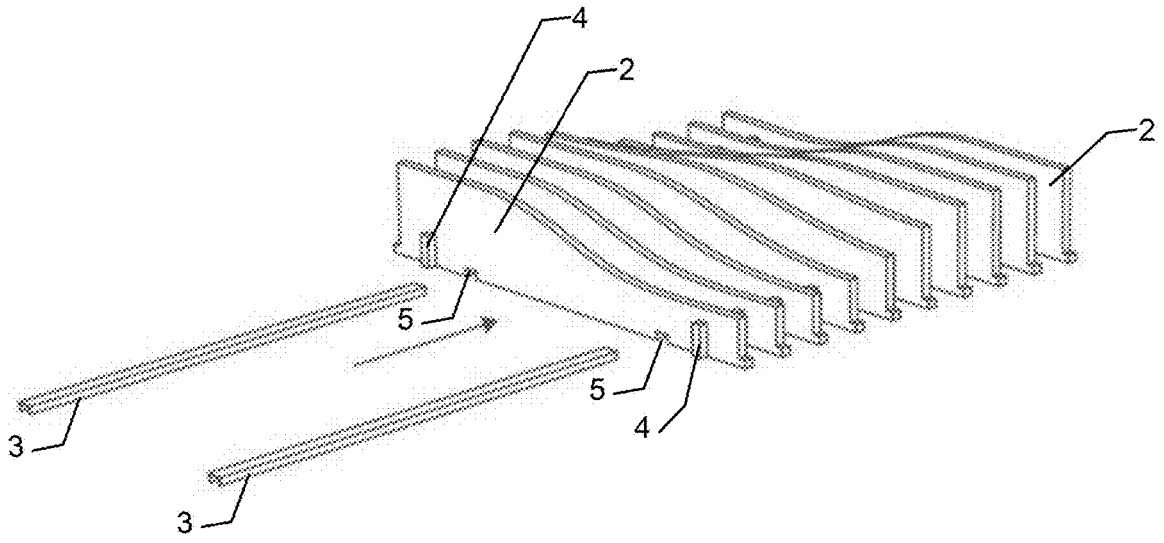

Once all the components have been removed from the protective surround portion 9, the blade members 2 and cross members 4 are assembled together to form an arrangement, as shown in FIG. 4B. This is achieved by slidably inter-engaging the respective slots 6 and 7 on the cross members 4 and blade members 2 to form a series of halved joints.

Where the blade members 2 have differing shapes, they may be connected to the cross members 4 in a pre-determined order to achieve the desired decorative visual appearance of the module. FIGS. 4B and 4C show that, in the illustrated implementation, the blade members 2 each have a portion cut away from their exposed longitudinal edge and are connected in an order to create the impression of an undulating surface.

As shown in FIG. 4C, the support rails 3 are then slidably introduced through the aligned notches 5 in the blade members 2. The support rails 3 are positioned such that they extend across the width of the assembly and have a projecting portion on each side of the assembly for releasably engaging the suspended ceiling grid structure to support the blade members 2 therefrom.

Figure 4D:
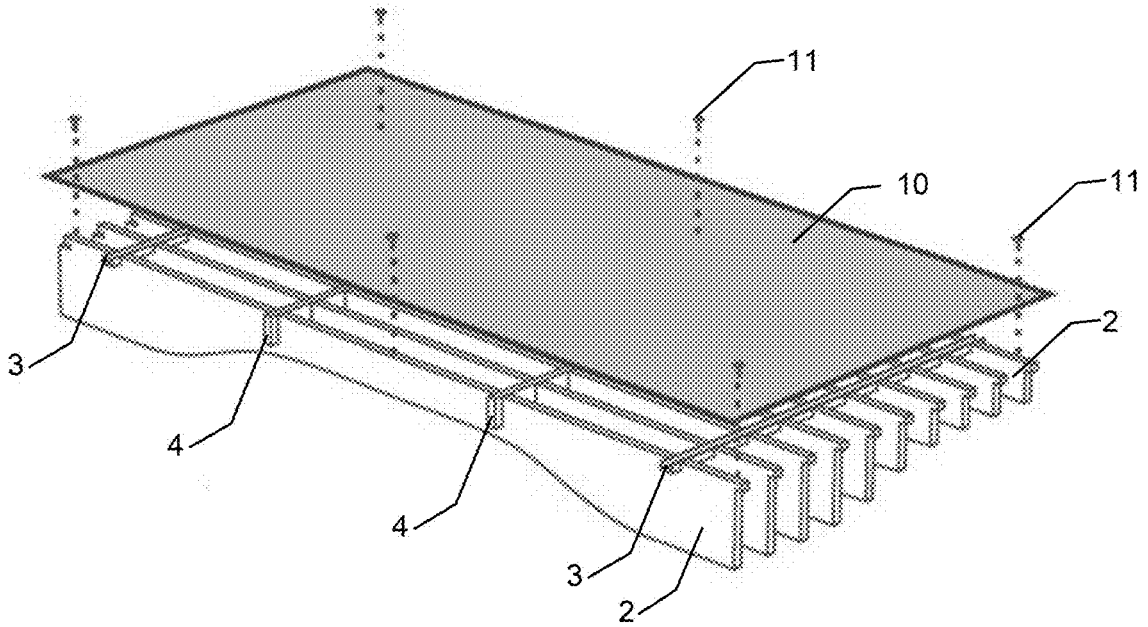

A cover 10 in the form of a scrim is then attached to the arrangement to cover the arrangement, as shown in FIG. 4D. The cover is attached by a series of fasteners in the form of pins 11 that extend through the cover 10 and into the blade members 2. The cover 10 advantageously obscures a void above the suspended grid ceiling structure from view. In other implementations, where it is desirable that the void be visible, the cover 10 may be omitted. The cover 10 also advantageously prevents dust or other debris falling from the void space into the area below the suspended ceiling.

The cover 10 also contributes to the sound absorbing qualities of the module 1. The thickness and material of the cover may be selected to adjust the level of sound absorption.

Figure 4E:
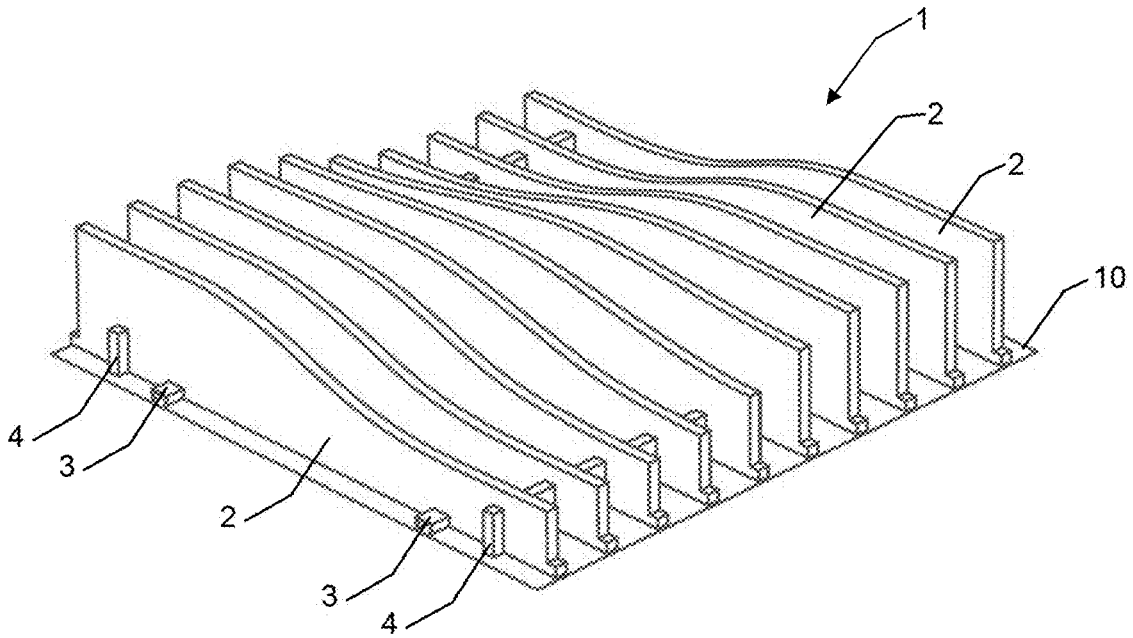

FIG. 4E illustrates a completed ceiling module 1, inverted for ease of viewing the details of the blade members 2, support rails 3 and spacing members 4.

FIGS. 5A to 5F and FIGS. 6A to 6E illustrate assembly processes for two alternative implementations of a ceiling module according to the present disclosure. In these implementation, each module 1 has four blade members 2 and eight spacing members 4. As can be seen in these implementations, particularly in FIGS. 5F and 6E, the spacing members 4 contribute to the decorative visual appearance of the module 1 in combination with the blade members 2.

Figure 5F:
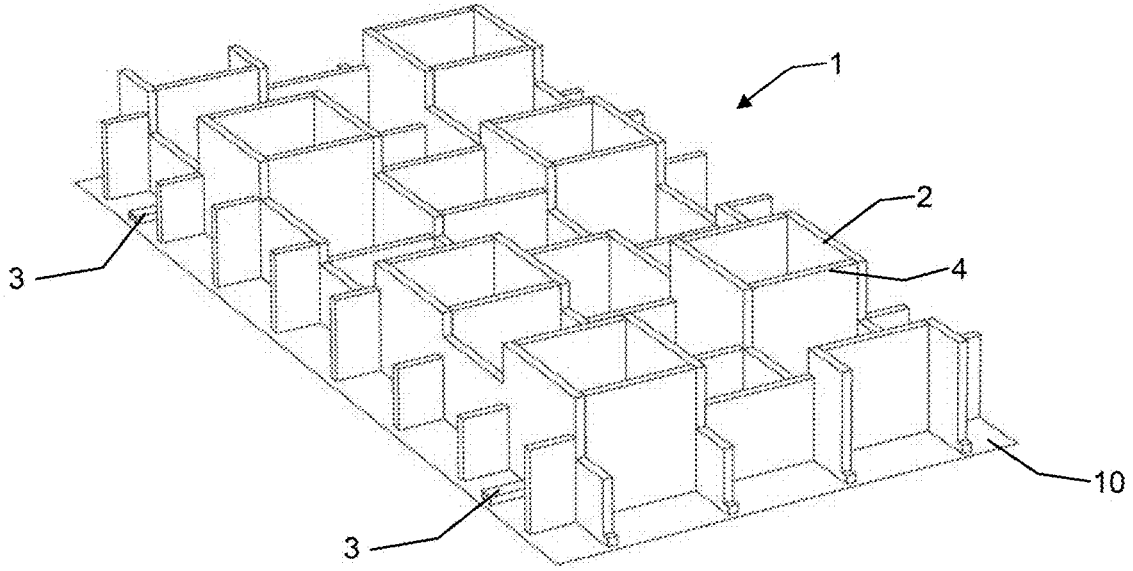
Figure 6A:
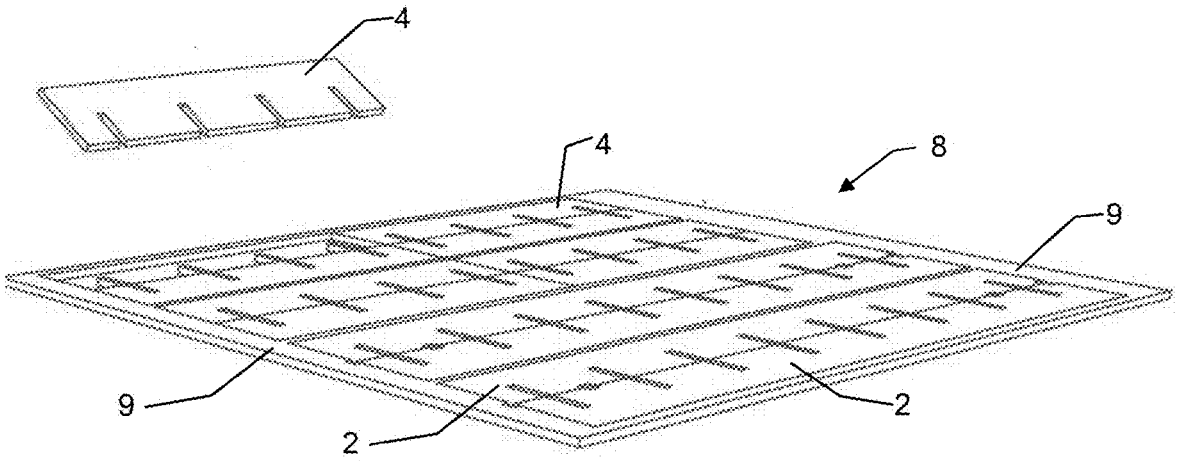
FIGS. 6A to 6E are perspective views illustrating a series of assembly steps for assembling a ceiling module according to another implementation of the present disclosure.
Figure 6B:
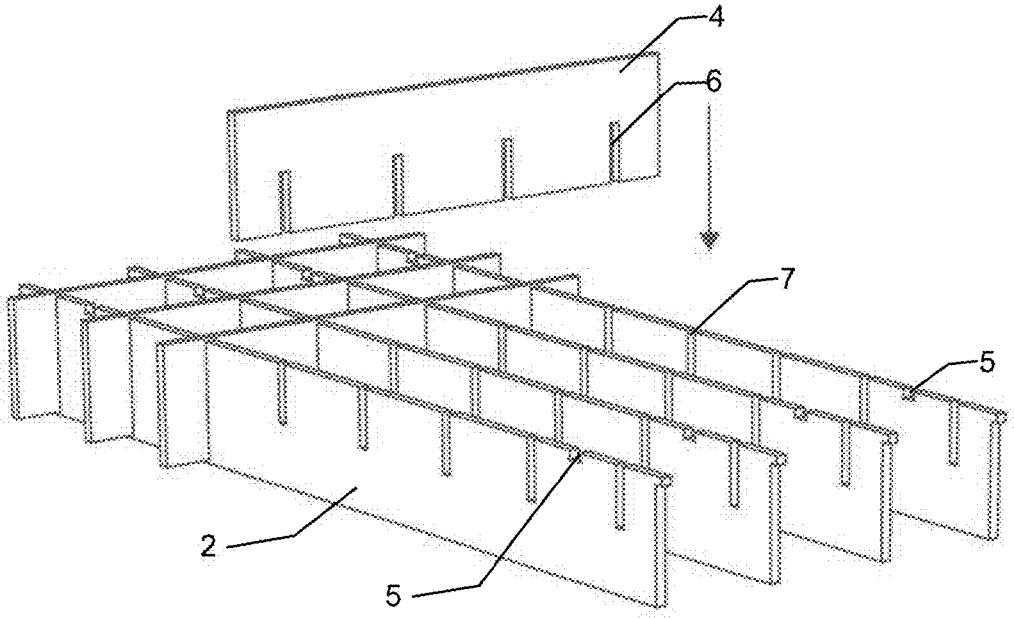
Figure 6C:
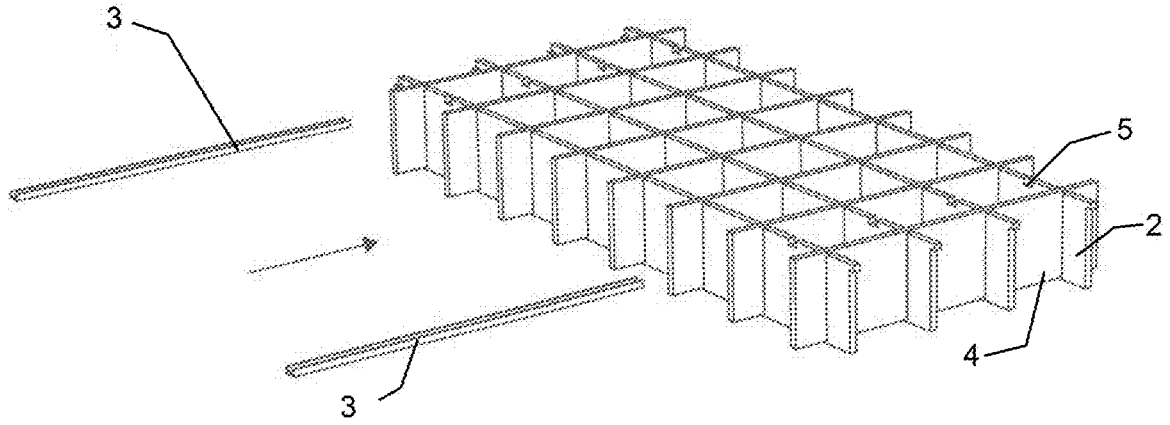
Figure 6D:
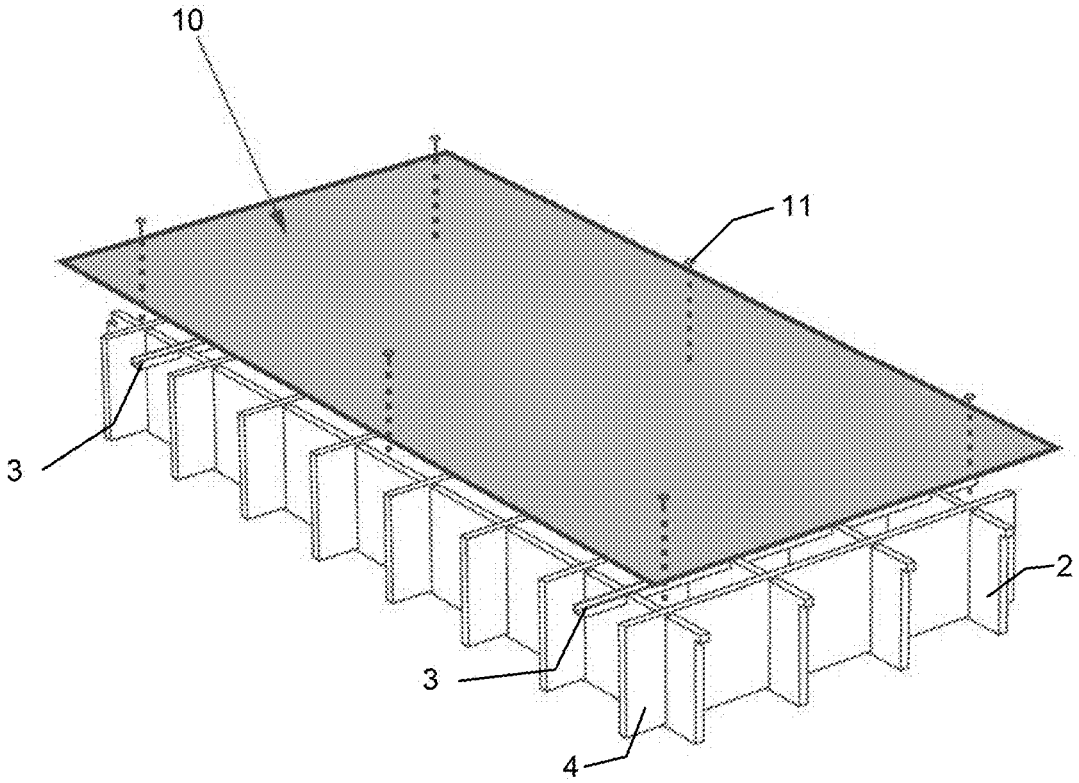
Figure 6E:
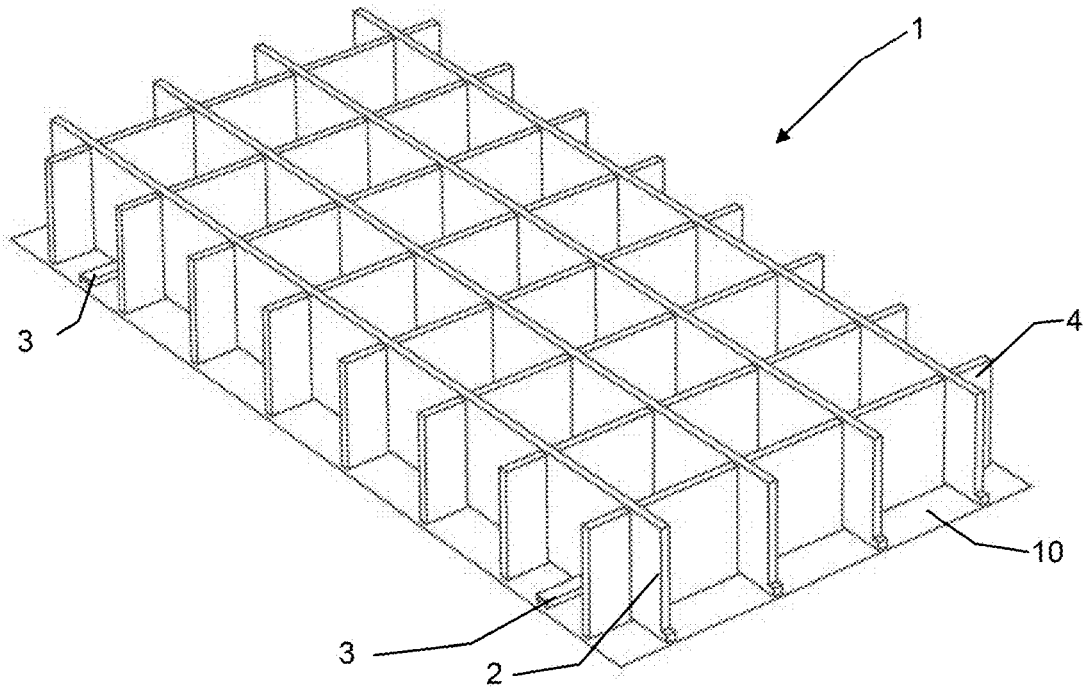

In these implementations, the space between each adjacent blade member 2 is substantially equal to the space between each adjacent spacing member 4 to create a grid or lattice appearance. FIG. 5F illustrates an implementation wherein the blade members 2 and spacing members 4 have portions of their exposed longitudinal edges cut away to create the appearance of a series of square profiled tubes extending orthogonally to the plane of the suspended ceiling grid structure. In contrast, FIG. 6E illustrates an implementation in which the exposed longitudinal edges of the blade members and spacing members are substantially level (apart from the notches 5 and slots 6 and 7), creating the appearance of a grid or lattice defining a substantially flat plane parallel to the plane defined by the suspended ceiling grid structure.

Figure 5A:
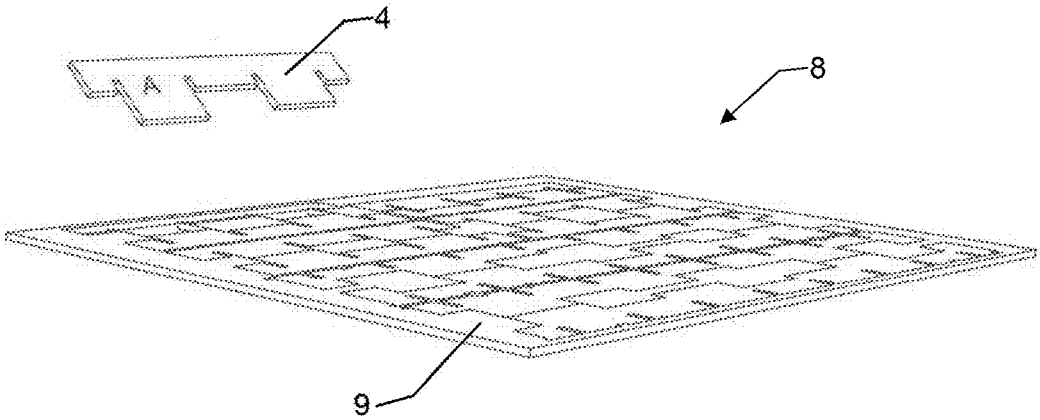
FIGS. 5A to 5F are perspective views illustrating a series of assembly steps for assembling a ceiling module according to another implementation of the present disclosure.
Figure 5B:
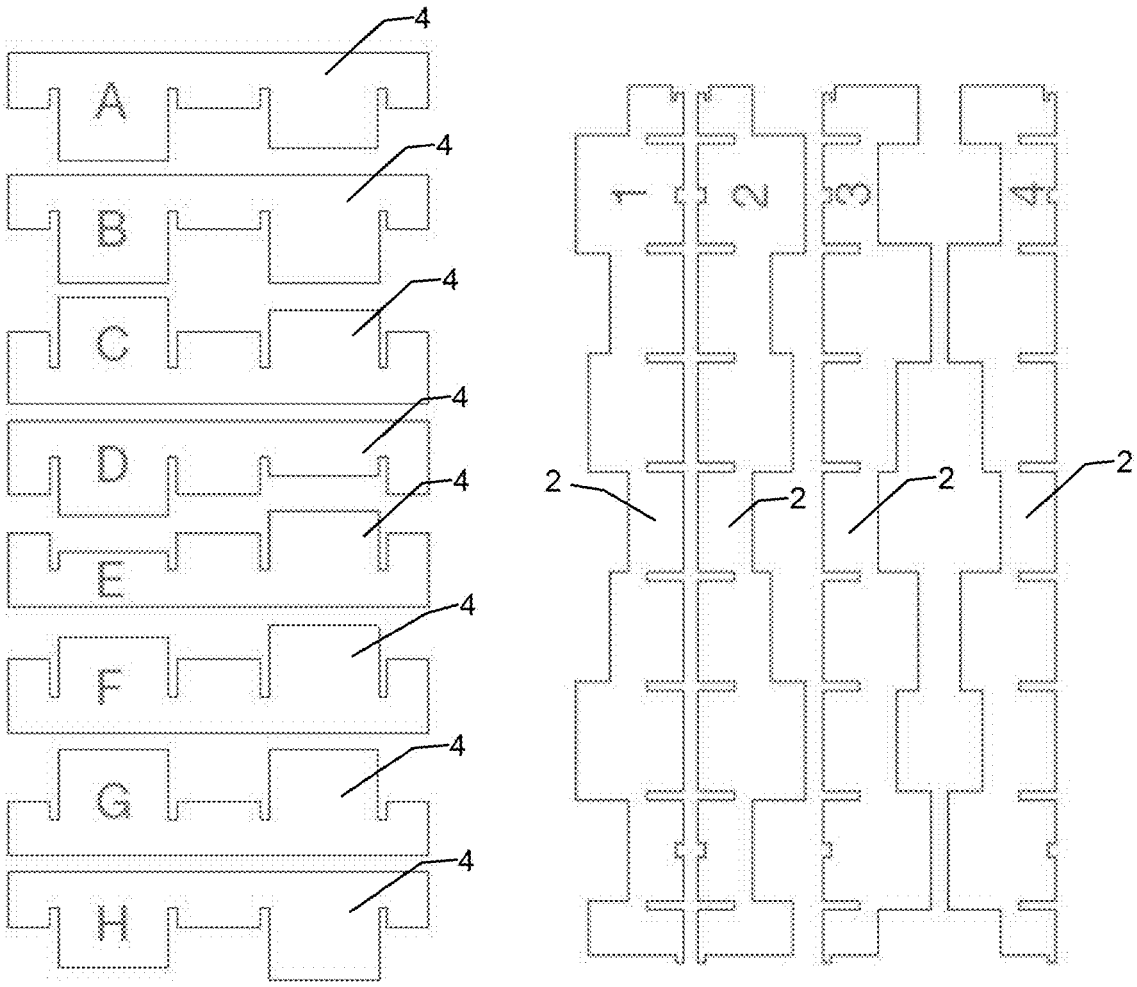
Figure 5C:
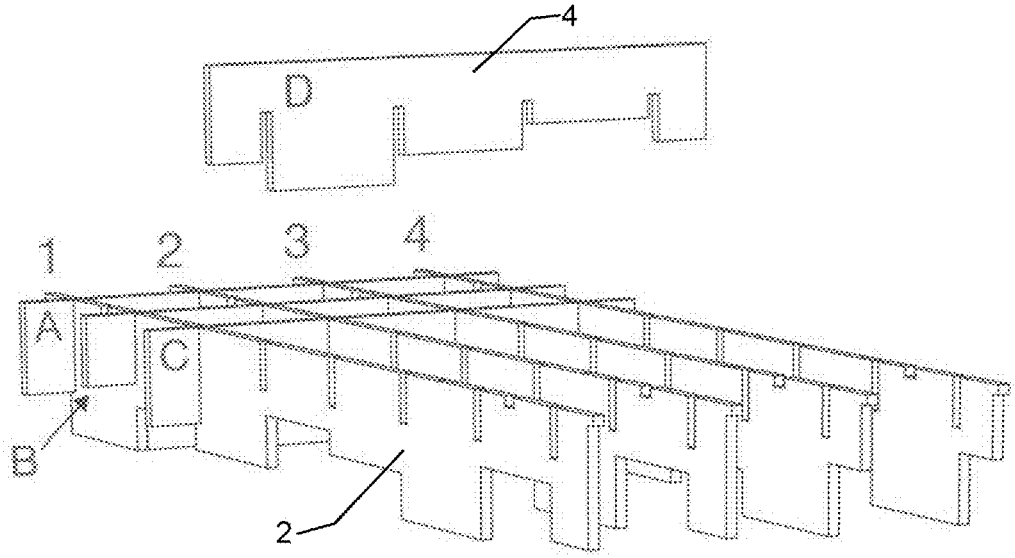
Figure 5D:
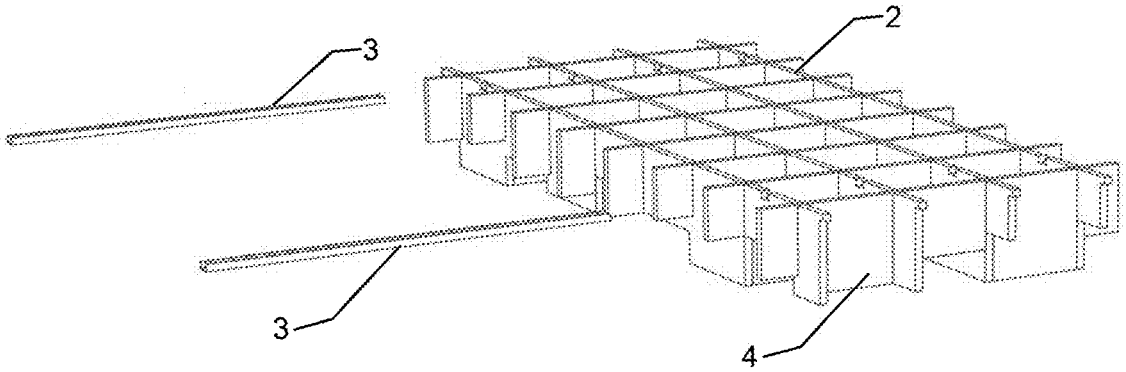
Figure 5E:
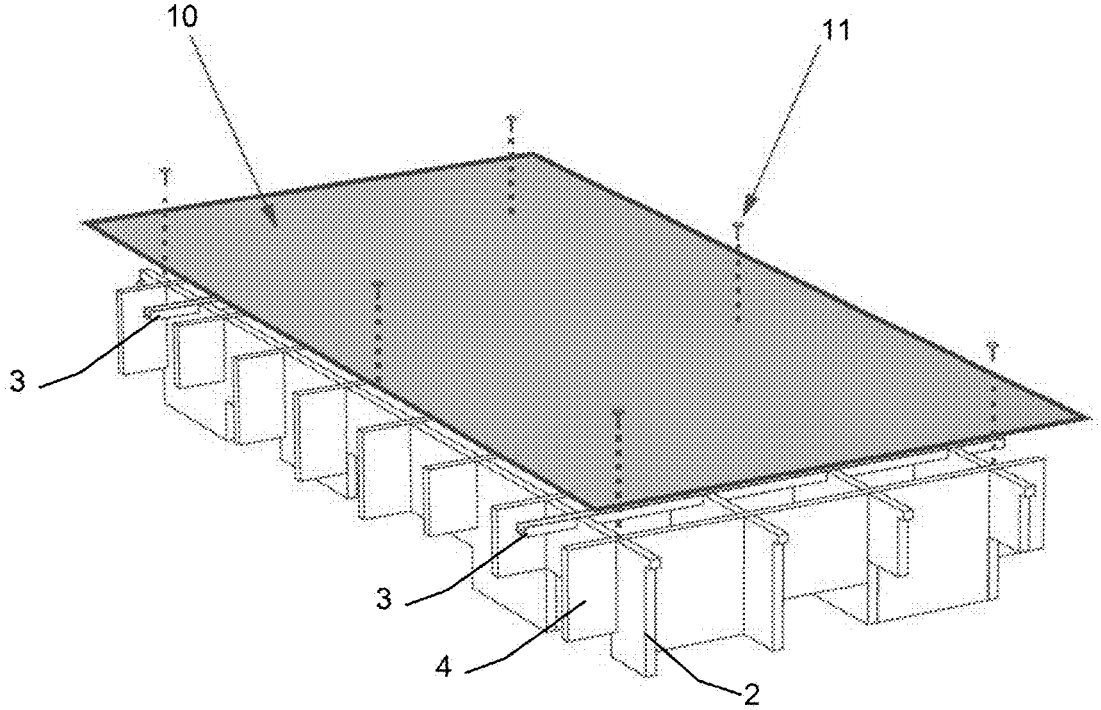

FIG. 5B shows one method of labelling the blade members 2 and spacing members 4 to indicate the order of assembly to a user. In this implementation, each blade member 2 and spacing member 4 is labelled with an alpha-numeric character. FIG. 5C shows the blade members 2 and spacing members 4 being assembled in order according to their assigned alpha-numeric characters (for example 1 to 4 from left to right for the blade members and A to H from back to front for the spacing members) to create the module 1.

FIGS. 7A to 7D and 8A to 8D illustrate a method of determining the portions of the exposed longitudinal edges of the blade members 2 which are to be cut away to create the appearance of a three-dimensional relief using computer assisted design (CAD).

Figure 7A:
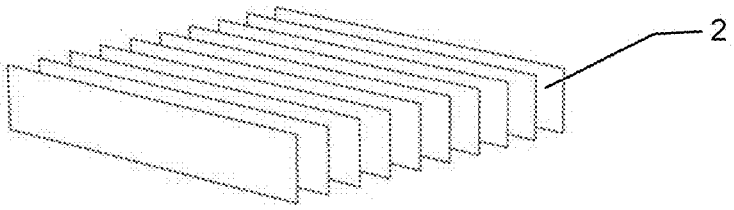
FIGS. 7A to 7D are perspective views illustrating creation of a three-dimensional relief within a ceiling module according to another implementation of the present disclosure.
Figure 7B:
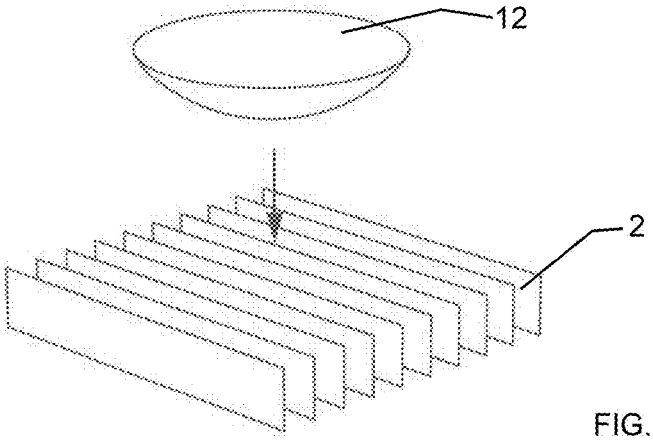
Figure 7C:
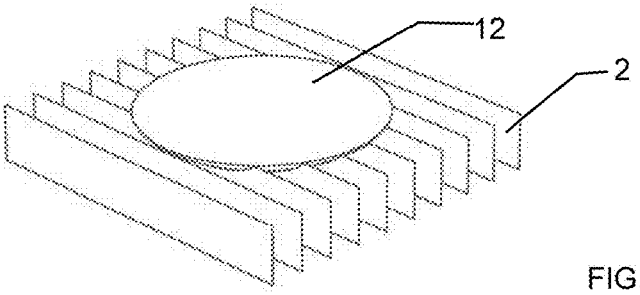
Figure 7D:
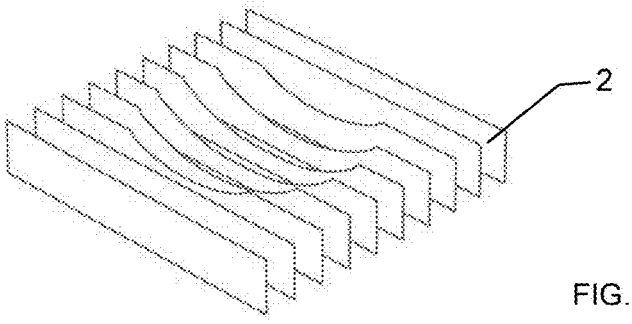
Figure 8A:
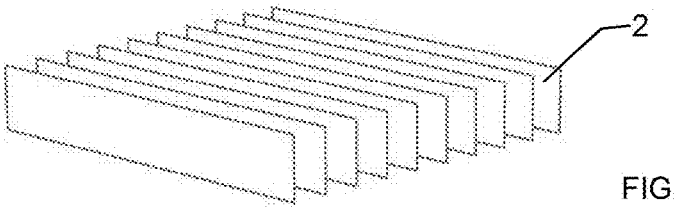
FIGS. 8A to 8D are perspective views illustrating creation of a three-dimensional relief within a ceiling module according to another implementation of the present disclosure.
Figure 8B:
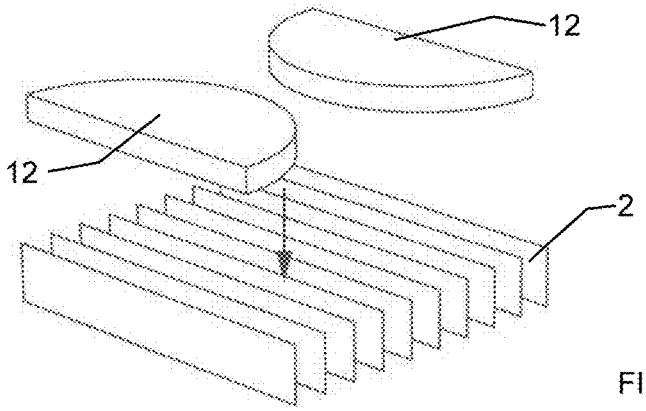
Figure 8C:
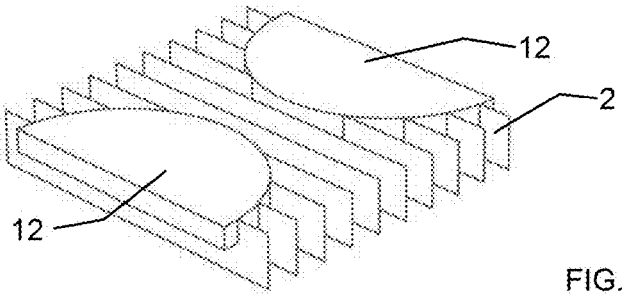
Figure 8D:
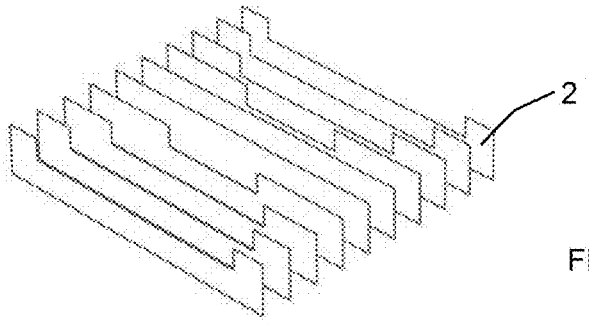

FIGS. 7A and 8A, show a set of rectangular blade member 2 profiles. A mold form 12 of a predetermined shape is selected, as shown for example in FIGS. 7B and 8B. The desired positioning of the mold form 12 relative to the blade member 2 profiles is then determined, as shown in FIGS. 7C and 8C, and the portions of the blade members 2 lying within the three-dimensional area of the mold form 12 are subtracted or removed from the respective blade member 2 profiles to produce a modified set of blade member 2 profiles as shown in FIGS. 7D and 8D. These modified profile shapes can then be used to produce a physical set of blade members 2 corresponding to the desired design. A similar method may also be applied in respect of spacing members 4. It will be appreciated that this method allows for customization of the shape of each blade member 2 and spacing member, and, therefore, customization of the decorative visual appearance of the ceiling module 1.

The CAD design process can be completed by a user (typically an architectural specifier or designer) via an online or downloadable interactive digital design tool, reducing the need for third-party input. To achieve this, a standard three-dimensional CAD model template of a ceiling module 1 according to the present disclosure is provided to the user. The CAD model is provided with design guidelines, for example, relating to the maximum amount of material that can be removed from the blade members 2 and/or spacing members 4, the minimum shape radius, minimum wall thickness and other similar constraints. The user downloads the standard three-dimensional CAD model and modifies the model using CAD software (for example, using a process similar to that shown in FIGS. 7A to 7D). The user then uploads the modified model. The modified model is then checked, preferably automatically, to ensure that it complies with the design guidance. If the modified model does not comply with the design guidance, the user is provided with non-compliance feedback. Once a design complying with the design guidelines is received, fabrication drawings and optionally a fabrication quote are generated based on the modified model.

It will be appreciated that the ceiling module 1 of the present disclosure visually enhances suspended ceiling grid systems, and therefore provides an improved room aesthetic. Further the ability to readily customize the appearance of the ceiling module is advantageous as it allows architectural specifiers or designers to incorporate project specific attributes into the ceiling design. This also reduces the likelihood of product substitution by builders.

Figure 9:
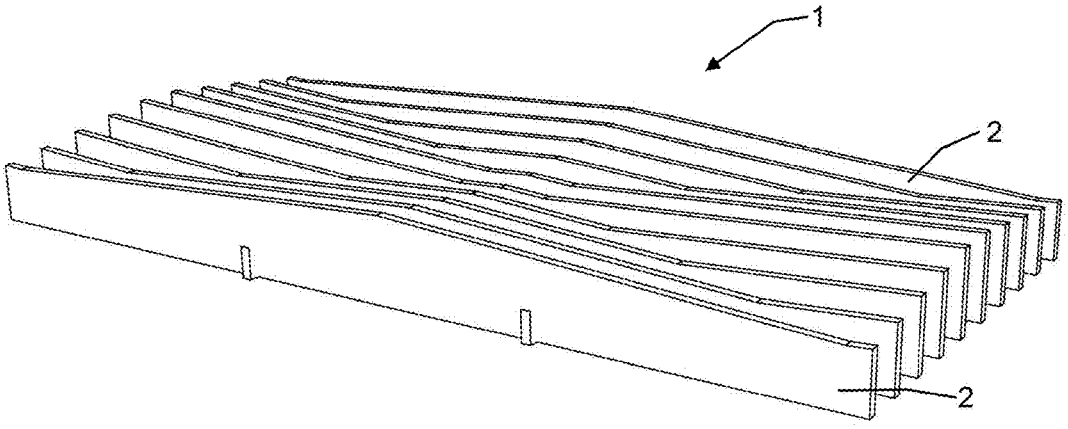
FIG. 9 is a perspective view of a ceiling module according to another implementation of the present disclosure.
Figure 10:
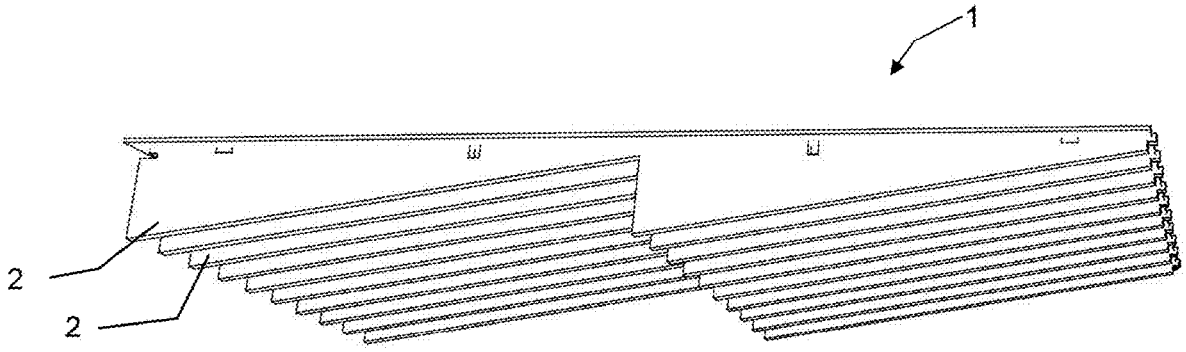
FIG. 10 is a perspective view of a ceiling module according to another implementation of the present disclosure.

FIGS. 9 and 10 show further implementations of ceiling modules 1 according to the present disclosure with alternative blade member 2 shapes.

Figure 11A:
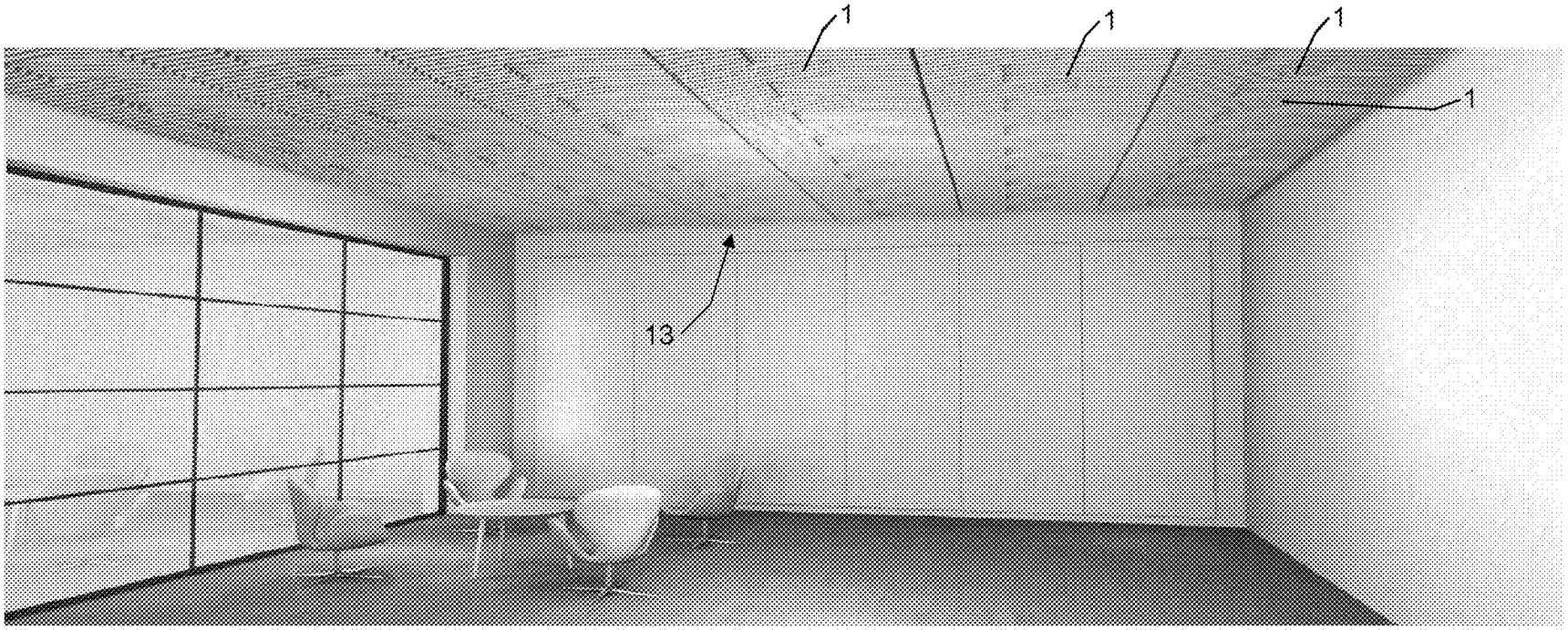
FIG. 11A illustrates a suspended ceiling utilizing a plurality of ceiling modules according to another implementation of the present disclosure.
Figure 11C:
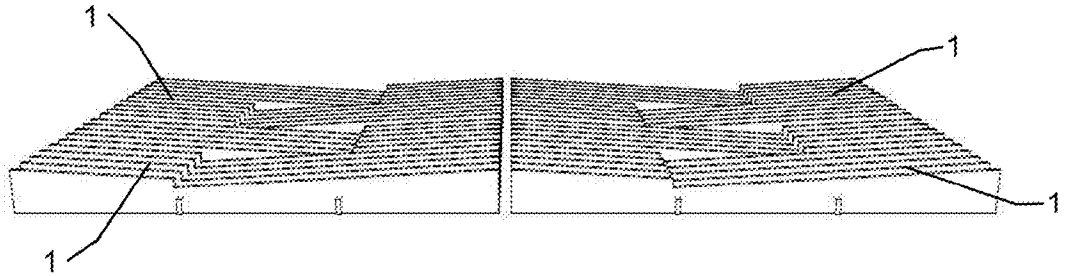
FIG. 11C is a perspective view of four ceiling modules according to FIG. 11B joined together.
Figure 11B:
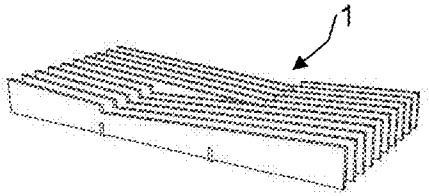
FIG. 11B is a perspective view of a single ceiling module of the type used in FIG. 11A.

FIG. 11A shows a suspended ceiling 13 utilizing a plurality of ceiling modules according to the present disclosure to cover the ceiling space. FIG. 11B shows a single ceiling module 1, while FIG. 11C shows four ceiling modules 1 in combination. As can be appreciated, the combination of multiple ceiling modules 1 provides an interesting and distinctive decorative visual effect to the ceiling 13. In the pictured implementation, the combined ceiling modules 1 create the impression of a woven surface on the ceiling 13. As can be appreciated, the ceiling modules partially conceal the suspended ceiling grid structure from view.

Figure 12A:
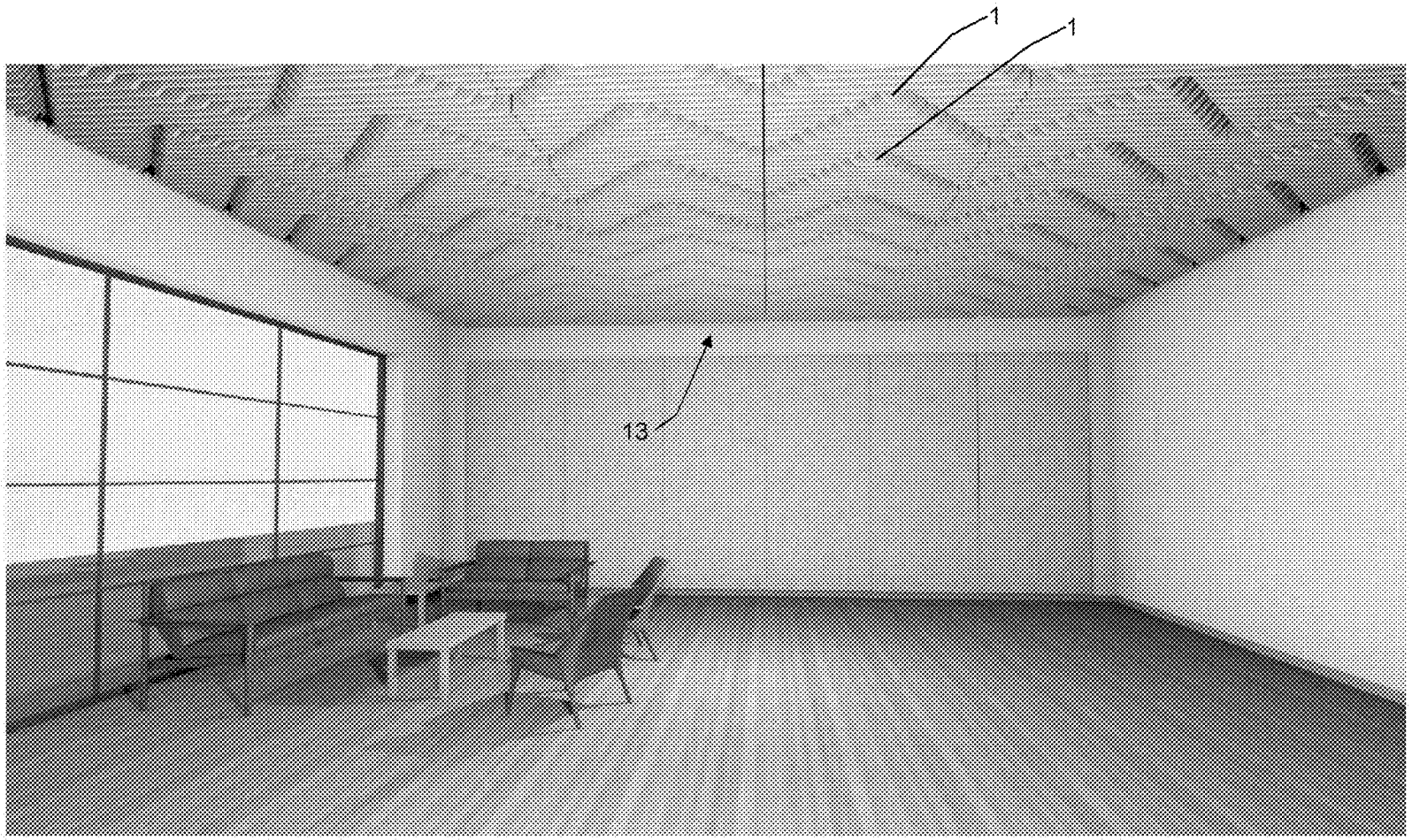
FIG. 12A illustrates a suspended ceiling utilizing a plurality of ceiling modules according to another implementation of the present disclosure.
Figure 12C:
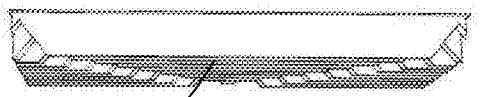
FIG. 12C is a front perspective view of the ceiling module of FIG. 12B.
Figure 12B:
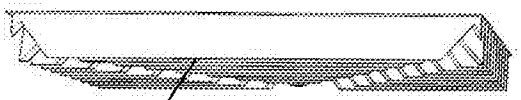
FIG. 12B is a perspective view of a single ceiling module of the type used in FIG. 12A.

FIGS. 12A to 12C similarly show the effect of a combination of ceiling modules 1, in this case to create the appearance of a chevron pattern on the ceiling 13.

The dimensions of the ceiling module 1 can be easily customized to suit the grid structure of the suspended ceiling into which it will be installed. The ceiling modules 1 can easily be removed after installation to gain access to building utilities or services in a void space above the suspended ceiling grid structure.

Figure 13A:
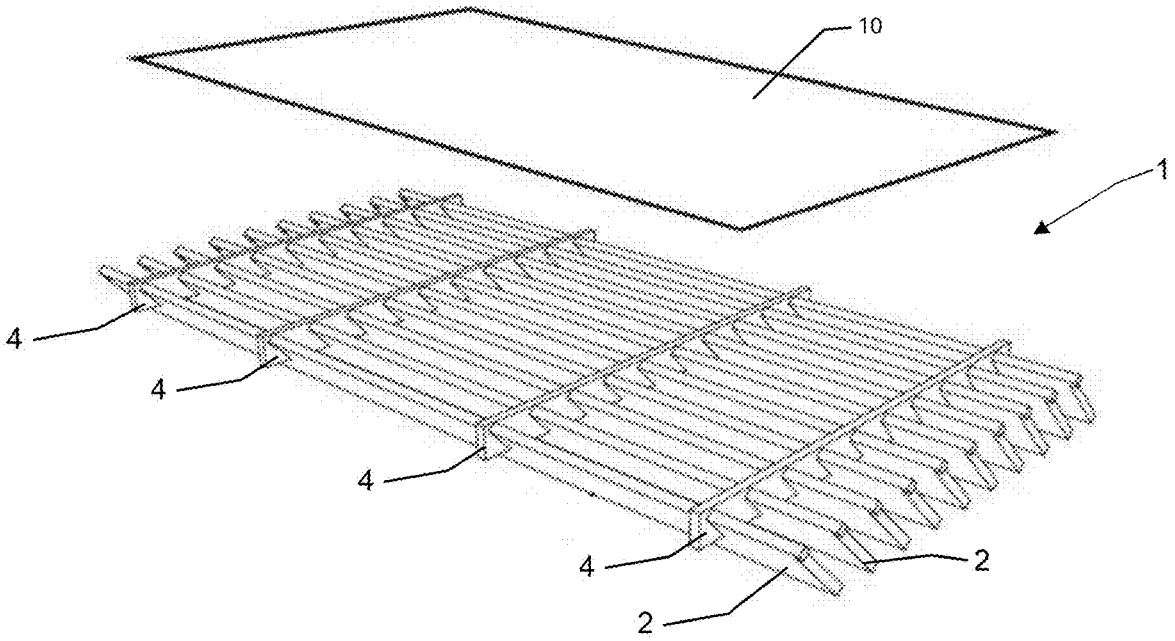
FIGS. 13A and 13B show a perspective and end view, respectively, of a ceiling module according to another implementation of the present disclosure.
Figure 13B:
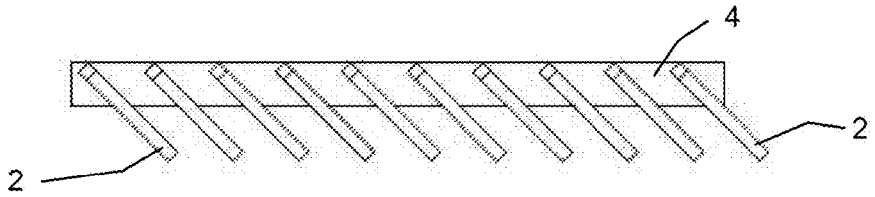

FIGS. 13A and 13B illustrate another implementation of a ceiling module 1 according to the present disclosure, in which the blade members 2 are slanted, or angled, relative to the plane defined by the suspended ceiling grid structure. In this implementation, the faces of the blade members 2 are all parallel to each other.

Figure 14A:
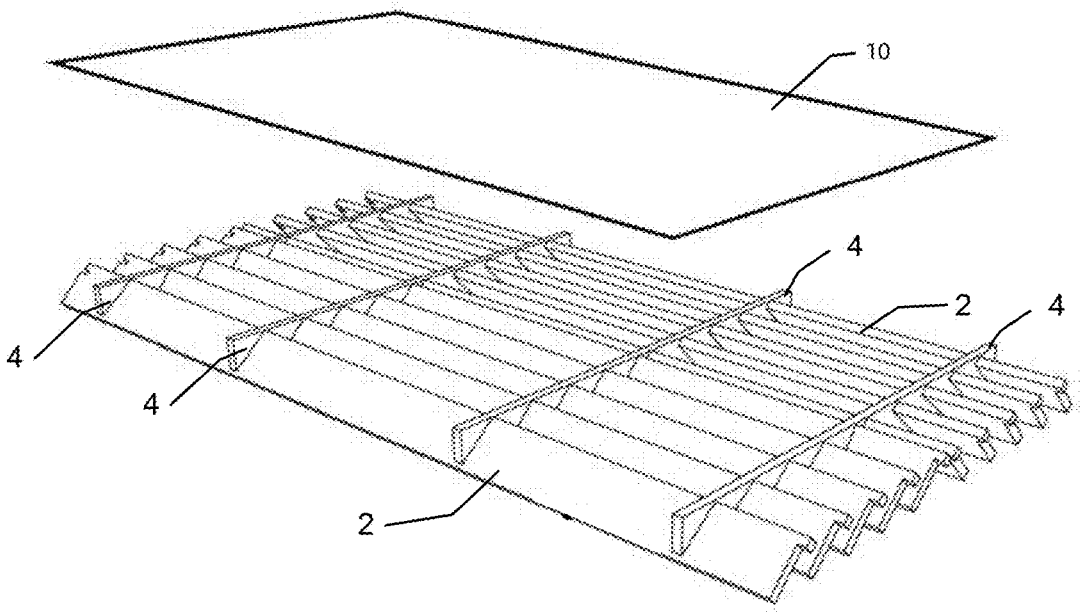
FIGS. 14A and 14B show a perspective and end view, respectively, of a ceiling module according to another implementation of the present disclosure.
Figure 14B:
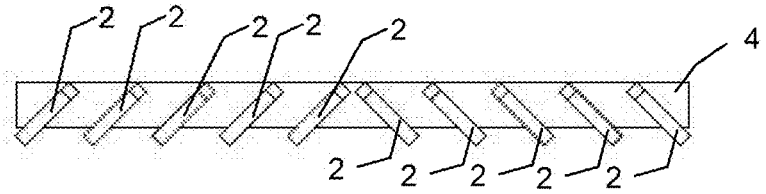

FIGS. 14A and 14B illustrate yet another implementation of a ceiling module 1 according to the present disclosure, in which the blade members 2 are slanted, or angled, relative to the plane defined by the suspended ceiling grid structure. In this implementation, the blade members 2 are divided into two groups of blade members 2 slanted at opposing angles.

Figure 15A:
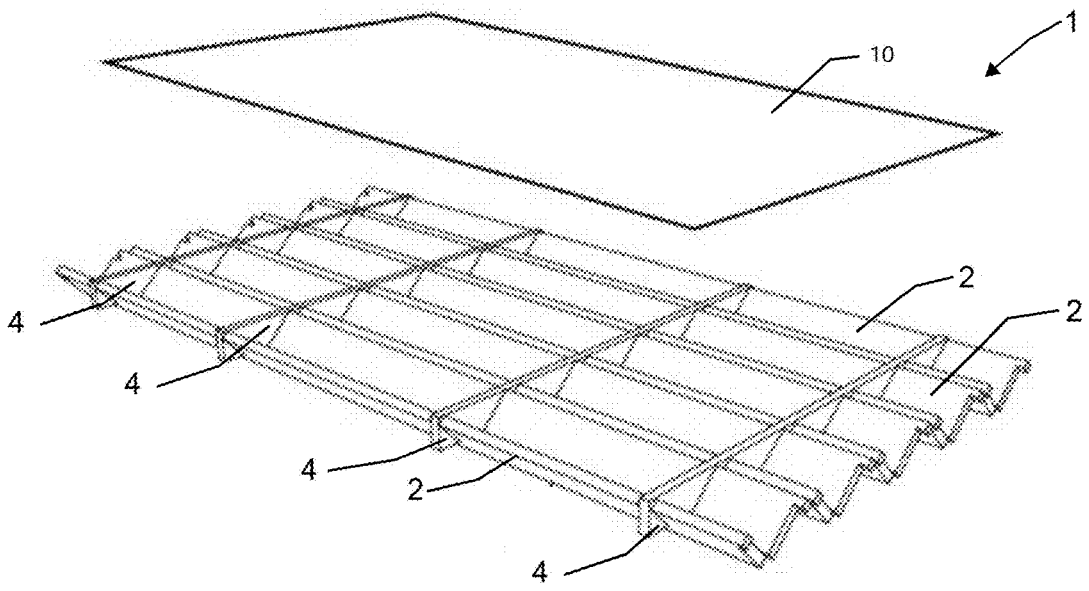
FIGS. 15A and 15B show a perspective and end view, respectively, of a ceiling module according to another implementation of the present disclosure.
Figure 15B:
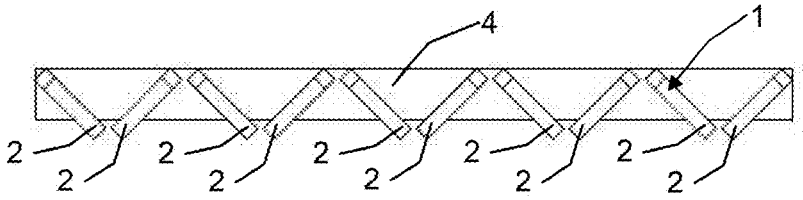

FIGS. 15A and 15B illustrate yet another implementation of a ceiling module according to the present disclosure, in which the blade members 2 are slanted, or angled, relative to the plane defined by the suspended ceiling grid structure. In this implementation, the angle of the blade members 2 alternates between adjacent blade members such that the faces of every second blade member are parallel with each other.

Figure 16A:
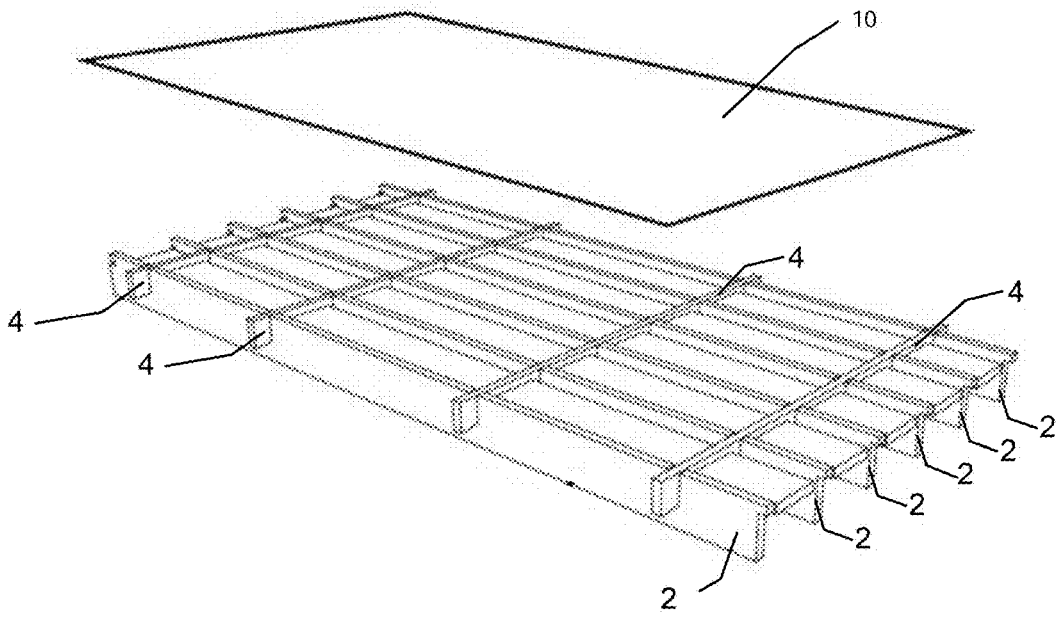
FIGS. 16A and 16B show a perspective and end view, respectively, of a ceiling module according to another implementation of the present disclosure.
Figure 16B:
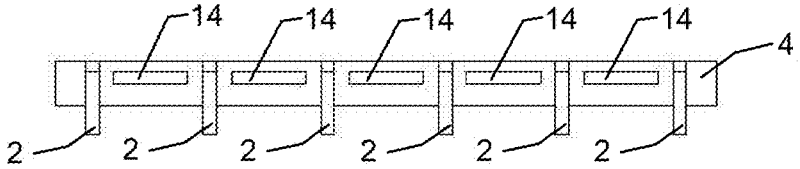

FIGS. 16A and 16B illustrate yet another implementation of a ceiling module according to the present disclosure, in which the faces of the blade members 2 are orthogonal to the plane defined by the suspended ceiling grid structure. The faces of adjacent blade members 2 are opposed and parallel. In this implementation, a secondary elongate member 14 is provided between each adjacent pair of blade members and extends parallel to the blade members 2.

It will be appreciated that the present disclosure is not limited to the example implementations illustrated in FIGS. 13A to 16B. It will be apparent to those skilled in the art that the examples provided are by no means exhaustive and that the many other arrangements of blade members are possible within the scope of the present disclosure. It will be appreciated that the customizability of the present disclosure is advantageous in providing choice to architects, builders, interior designers or other such persons.

FIGS. 17A to 24B illustrate various implementations of ceiling modules according to the present disclosure adapted to engage a lighting fixture 15. It will be appreciated that the present disclosure is not limited to these examples and that the ceiling module may be configured to be installed in proximity to and/or engage with light fixtures, or other fixtures such as smoke alarms, vents, fans, sprinklers or similar, in other ways.

FIGS. 17A, 17B and 17C illustrate another implementation of a ceiling module according to the present disclosure in which the blade members 2 are configured to collectively define a cavity 16 for receiving a lighting fixture 15, such as an LED strip light. In the illustrated implementation, a lighting fixture in the form of a single light strip 15 is provided and the light is partially concealed from view.

FIGS. 18A, 18B and 18C illustrate another implementation of a ceiling module 1 according to the present disclosure in the ceiling modules 1 is adapted to receive lighting fixtures in the form of a plurality of LED lighting strips 15.

FIGS. 19A, 19B and 19C illustrate another implementation of a ceiling module according to the present disclosure in which the ceiling module is adapted to receive a plurality of lighting fixtures in the form of lighting strips 15 within a respective plurality of cavities 16 defined by the collective blade members 2 such that the lighting fixtures 15 are partially concealed from view.

FIGS. 20A, 20B and 20C illustrate another implementation of a ceiling module 1 according to the present disclosure in which the ceiling module is adapted to receive a plurality of lighting fixtures in the form of lighting strips 15 and wherein the blade members 2 are configured such that the lighting strips 15 are exposed to view.

FIGS. 21A and 21B illustrate another implementation of a ceiling module 1 according to the present disclosure in which the ceiling module is adapted to receive lighting fixtures in the form of lighting strips 15 between the blade members 2, secured to the spacing members 4.

FIGS. 22A and 22B illustrate another implementation of a ceiling module 1 according to the present disclosure in which the ceiling module is adapted to receive lighting fixtures in the form of strips 15 along the exposed longitudinal edges some of the blade members 2.

FIGS. 23A and 23B illustrate another implementation of a ceiling module 1 according to the present disclosure in which the ceiling module is adapted to be installed in proximity to a lighting fixture in the form of a downlight 15, or other lighting fixture, secured above the ceiling module 1. The blade members 2 and cover 10 are each configured such that the downlight 15 is visible through the module.

FIGS. 24A and 24B illustrate another implementation of a ceiling module 1 according to the present disclosure in which the ceiling module is adapted to receive lighting fixtures in the form of strips 15 between the blade members 2, secured to the spacing members 4. As shown in the two end views of FIG. 24B, the size and/or shape of blade members 2 adjacent the lighting strip 15 may be modified as desired to influence the directionality and intensity of the light emitting from the lighting fixtures 15.

Advantageously, the present disclosure provides a lightweight ceiling module adapted for use with conventional suspended ceiling grid structures, the ceiling module having a customizable decorative visual appearance and sound absorbing characteristics.

Although the present disclosure has been described with reference to specific examples it will be appreciated by those skilled in the art that the present disclosure may be embodied in many other forms.

The various implementations described above can be combined to provide further implementations. These and other changes can be made to the implementations in light of the above-detailed description. In general, in the following claims, the terms used should not be construed to limit the claims to the specific implementations disclosed in the specification and the claims, but should be construed to include all possible implementations along with the full scope of equivalents to which such claims are entitled. Accordingly, the claims are not limited by the disclosure.

The invention claimed is:

1. A ceiling module mountable for use on a suspended ceiling grid structure, the ceiling module including:

a plurality of elongate blade members, each blade member having two opposing faces, at least a part of the faces of at least two adjacent blade members being substantially mutually opposed;

at least one elongate cross member extending at least between at least two adjacent blade members such that the plurality of blade members are connected to form the ceiling module and define a plurality of voids between the blade members;

at least one support member, releasably engageable with the suspended ceiling grid structure and associated with at least one of the blade members to mount the ceiling module from the suspended ceiling grid structure; and a cover attachable to any one of the blade members, cross members, or support members, the cover extending across at least two or more of the plurality of voids.

2. The ceiling module according to claim 1 wherein each blade member extends substantially parallel to a plane defined by the suspended ceiling grid structure.

3. The ceiling module according to claim 1 wherein the at least one support member is integral with at least one cross member.

4. The ceiling module according to claim 3 wherein the at least one support member extends through the associated at least one blade member to support the associated at least one blade member by an interference fit.

5. The ceiling module according to claim 1, the ceiling module including at least one spacing member adapted for locating the plurality of elongate blade members in a spaced apart configuration.

6. The ceiling module according to claim 5 wherein the spacing member is integral with at least one cross member.

7. The ceiling module according to claim 6 wherein the spacing member includes blade engaging features adapted to frictionally engage the plurality of elongate blade members.

8. The ceiling module according to claim 1 wherein exposed longitudinal edges of the plurality of blade members provide a decorative visual appearance to the ceiling module when viewed in combination.

9. The ceiling module according to claim 8 wherein at least a portion of at least one cross member contributes to the decorative visual appearance.

10. The ceiling module according to claim 1 wherein the ceiling module is configured to provide acoustic dampening when installed in the suspended ceiling grid structure.

11. The ceiling module according to claim 1 wherein the ceiling module is adapted to be installed in proximity to a fixture selected from the group including lights, emergency lights, vents, speakers, smoke detectors or sprinklers.

12. The ceiling module according to claim 1, wherein the cover extends across the plurality of voids.

13. The ceiling module according to claim 1, the cover is in the form of a sheet or a scrim.

14. The ceiling module according to claim 1, the cover contributes to acoustic dampening and/or sound wave absorption properties of the module.

15. A kit for use with a ceiling module, the kit comprising:

a plurality of elongate blade members, each blade member having two opposing faces;

at least one elongate cross member adapted to extend at least between at least two adjacent blade members to connect the blade members to form the ceiling module, such that at least a part of the faces of at least two adjacent blade members are substantially mutually opposed and a plurality of voids is formed between the blade members;

at least one support member adapted for releasable engagement with a suspended ceiling grid structure and adapted to be associated with at least one of the blade members to mount the ceiling module from the suspended grid ceiling structure; and a cover attachable to any one of the blade members, cross members, or support members and adapted for extending across at least two or more of the plurality of voids.

16. The kit according to claim 15 wherein each of the blade members is provided in at least one substantially flat sheet.

17. The kit according to claim 15, wherein the cover is adapted to extend across the plurality of voids.

18. The kit according to claim 15, wherein the cover is in the form of a sheet or a scrim.

19. A method of constructing a ceiling module for use with a suspended grid ceiling structure, the method comprising the steps of:

providing a plurality of elongate blade members, each blade member having two opposing faces;

providing at least one elongate cross member adapted to extend at least between at least two adjacent blade members to connect the blade members to form the ceiling module and define a plurality of voids between the blade members;

providing at least one support member adapted to be releasably engageable with the suspended grid ceiling structure and associated with at least one of the blade members to mount the ceiling module from a suspended ceiling grid structure;

connecting the blade members to the cross member such that at least a portion of the faces of at least two adjacent blade members are substantially mutually opposed; and attaching a cover to any one of the blade members, cross members, or support members such that the cover extends across at least two or more of the plurality of voids.

20. The method according to claim 19, wherein the cover extends across the plurality of voids.

* * * * *